US009232855B2

(12) United States Patent
Ergun et al.

(10) Patent No.: US 9,232,855 B2
(45) Date of Patent: Jan. 12, 2016

(54) HEIGHT ADJUSTABLE DESK SYSTEM AND METHOD

(71) Applicant: Ergotron, Inc., St. Paul, MN (US)

(72) Inventors: Mustafa A. Ergun, Plymouth, MN (US); Robert W. Fluhrer, Prior Lake, MN (US); Scott Trish, Lakeville, MN (US); Jeffrey Mensing, Blaine, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 14/461,932

(22) Filed: Aug. 18, 2014

(65) Prior Publication Data

US 2015/0047538 A1 Feb. 19, 2015

Related U.S. Application Data

(60) Provisional application No. 61/867,308, filed on Aug. 19, 2013.

(51) Int. Cl.

| | |
|---|---|
| ***A47B 9/00*** | (2006.01) |
| ***A47B 9/10*** | (2006.01) |
| ***A47B 9/02*** | (2006.01) |
| *A47B 9/12* | (2006.01) |

(52) U.S. Cl.

CPC ... *A47B 9/10* (2013.01); *A47B 9/02* (2013.01); *A47B 9/12* (2013.01)

(58) Field of Classification Search

CPC ..... A47B 9/00; A47B 9/10; A47B 9/12; A47B 9/20; F16M 11/32; F16B 7/10

USPC ..... 108/147, 144.11; 248/188.5, 188.2, 248/157, 439

See application file for complete search history.

(56) References Cited

U.S. PATENT DOCUMENTS

| | | | | |
|---|---|---|---|---|
| 3,675,597 | A | 7/1972 | Oddsen et al. | |
| 3,856,252 | A * | 12/1974 | Regis | 108/147 |
| 4,651,652 | A * | 3/1987 | Wyckoff | 108/147 |
| 5,114,109 | A | 5/1992 | Fitz et al. | |

(Continued)

FOREIGN PATENT DOCUMENTS

| | | |
|---|---|---|
| DE | 1529723 | 1/1970 |
| DE | 3406669 A1 | 8/1985 |

(Continued)

OTHER PUBLICATIONS

"International Application Serial No. PCT/US2014/051473, International Search Report mailed Nov. 21, 2014", 4 pgs.

(Continued)

*Primary Examiner* — Jose V Chen

(74) *Attorney, Agent, or Firm* — Schwegman Lundberg & Woessner, P.A.

(57) ABSTRACT

A height adjustable desk can include a work surface; and at least one leg assembly connected to the work surface. The at least one leg assembly can include: a first member; and a second member moveable relative to the first member along a longitudinal axis; and a counterbalance mechanism connected to the desk and configured to counteract a force exerted on the work surface. The counterbalance mechanism can include: a wheel; a gas spring having a cylinder and a moveable piston; a wheel moveably connected to the gas spring; and the tension member is connected to the leg assembly.

11 Claims, 42 Drawing Sheets

(56) References Cited

U.S. PATENT DOCUMENTS

| | | | | |
|---|---|---|---|---|
| 5,129,611 | A * | 7/1992 | Grover et al. | 108/147 |
| 5,282,593 | A * | 2/1994 | Fast | 248/188.4 |
| 5,400,721 | A | 3/1995 | Greene | |
| 5,495,811 | A * | 3/1996 | Carson et al. | 108/147 |
| 5,553,550 | A * | 9/1996 | Doyle | 108/147 |
| 5,682,825 | A * | 11/1997 | Manner | 108/147 |
| 5,715,759 | A * | 2/1998 | Lee | 108/147 |
| 5,941,182 | A * | 8/1999 | Greene | 108/147 |
| 6,085,670 | A * | 7/2000 | Genov | 108/147 |
| 6,152,049 | A * | 11/2000 | Schmidt | 108/147 |
| 6,474,246 | B2 * | 11/2002 | Hsu | 108/147 |
| 6,484,648 | B1 * | 11/2002 | Long | 108/147 |
| 6,494,005 | B2 * | 12/2002 | Zimmerman | 108/147 |
| 7,204,193 | B2 | 4/2007 | Scherrer et al. | |
| 7,364,124 | B2 | 4/2008 | Yuasa et al. | |
| 7,412,931 | B2 * | 8/2008 | Seidl et al. | 108/147 |
| 7,658,359 | B2 | 2/2010 | Jones et al. | |
| 7,743,716 | B1 | 6/2010 | Burka | |
| 7,752,932 | B2 | 7/2010 | Chen et al. | |
| 8,177,174 | B2 | 5/2012 | Griepentrog | |
| 8,286,927 | B2 | 10/2012 | Sweere et al. | |
| 8,333,159 | B2 | 12/2012 | Schroer et al. | |
| 8,342,465 | B2 * | 1/2013 | Koder | 248/188.5 |
| 2005/0002591 | A1 | 1/2005 | Buitmann | |
| 2006/0075941 | A1 | 4/2006 | Seidl et al. | |
| 2008/0250989 | A1 | 10/2008 | Kozlowski et al. | |
| 2009/0072101 | A1 * | 3/2009 | Stoelinga | 248/188.5 |
| 2011/0001032 | A1 | 1/2011 | Gardner | |
| 2011/0023758 | A1 * | 2/2011 | Overgaard et al. | 108/147 |
| 2011/0225903 | A1 * | 9/2011 | Lounis et al. | 248/188.5 |
| 2012/0043436 | A1 * | 2/2012 | Atkinson | 248/188.5 |
| 2012/0227642 | A1 * | 9/2012 | Sekikawa | 108/147 |
| 2012/0248273 | A1 | 10/2012 | Singer | |
| 2013/0126682 | A1 | 5/2013 | Tholkes et al. | |
| 2014/0034799 | A1 | 1/2014 | Fallows et al. | |

FOREIGN PATENT DOCUMENTS

| | | | |
|---|---|---|---|
| DE | 19626855 | A1 | 1/1998 |
| EP | 1987734 | B1 | 12/2010 |
| EP | 2422647 | A1 | 2/2012 |
| WO | WO-99/19247 | | 4/1999 |
| WO | WO-9919247 | A1 | 4/1999 |
| WO | WO-2008145399 | A1 | 12/2008 |
| WO | WO-2012025593 | A1 | 3/2012 |
| WO | WO-2015/026714 | A1 | 2/2015 |

OTHER PUBLICATIONS

"International Application Serial No. PCT/US2014/051473, Written Opinion mailed Nov. 21, 2014", 6 pgs.

* cited by examiner

HEIGHT ADJUSTABLE DESK SYSTEM AND METHOD

CLAIM OF PRIORITY

This patent application claims the benefit of priority, under 35 U.S.C. Section 119(e), to U.S. Provisional Patent Application Ser. No. 61/867,308, entitled "HEIGHT ADJUSTABLE DESK SYSTEM AND METHOD," filed on Aug. 19, 2013, which is hereby incorporated by reference herein in its entirety.

FIELD

The disclosure generally relates to systems and methods for height adjustable desks.

BACKGROUND

Height adjustable desks can be used in sit-to-stand applications.

SUMMARY

Examples of this disclosure include leg assemblies or risers comprising at least two or more tubes or "members". Tubes can have various diameters so that they can be located inside each other. Tubes can be slidably engaged and connected together via a telescoping mechanism. Tubes or members can be slidably engaged and connected together via a non-telescoping mechanism. One of the tubes can be fixed, and the other tube or tubes can slide out of the fixed tube to provide a height adjustment. When combined, the leg assemblies can provide a highest desk height required for tall users in a standing position, and, when the smaller tubes collapse, the leg assemblies can provide a lowest desk height required by shorter users in a seated position.

In some examples, the leg assemblies or risers can include a counterbalancing mechanism. The counterbalancing mechanism can include a spring such as a coil or gas spring, a wheel, such as a pulley or a rotary cam mechanism, and a tension member. The counterbalancing mechanism can be configured to counteract a force provided by the weight of a desk or work surface attached to one or more leg assemblies and the weight of any components which can be supported by the work surface. In some examples, a counterbalancing mechanism can be included in each leg assembly of the height adjustable desk. The leg assemblies can be used individually as a single leg assembly centered under a desk surface, or two or more synchronized leg assemblies can be used under the desk surface for height adjustment. In other examples, the counterbalancing mechanism can be located between the leg assemblies and parallel to the desk surface, such as underneath a work surface.

In another example, an adjustable desk can include a weight counterbalance mechanism that uses a gas spring and a pulley assembly. This example can be applied to two member or three member telescoping leg assemblies or risers, as well as non-telescoping leg assemblies or risers to support a work surface. In this disclosure, a leg or riser can be any generally vertical supporting structure and the terms can be used interchangeably. A work surface can be supported by a single leg assembly or multiple leg assemblies. In this disclosure, using a pulley arrangement in association with a gas spring, a total height adjustment of four times the gas spring stroke can be achieved.

In another example, the leg assembly can be a lift mechanism, that can provide support and counteract a downward force for numerous applications including a work surface, table, or desk.

To further illustrate the HEIGHT ADJUSTABLE DESK SYSTEM AND METHOD disclosed herein, a non-limiting list of examples is provided here:

In Example 1, a height adjustable desk can comprising: a work surface; and at least one leg assembly connected to the work surface, the at least one leg assembly including: a first member; and a second member moveable relative to the first member along a longitudinal axis; and a counterbalance mechanism connected to the desk and configured to counteract a force exerted on the work surface. The counterbalance mechanism can include: a gas spring having a cylinder and a moveable piston; a wheel moveably connected to the gas spring; and a tension member engaged to the wheel, the tension member connected to the leg assembly.

In Example 2, the height adjustable desk of Example 1 can optionally be configured such that the cylinder extends from a closed end to a piston end, the closed end being attached to one of a first member upper end, a first member lower end, a second member upper end, and a second member lower end.

In Example 3, the height adjustable desk of any one or any combination of Examples 1-2 can optionally be configured to comprise a third member moveable relative to the second member along a longitudinal axis.

In Example 4, the height adjustable desk of Example 3 can optionally be configured such that the cylinder extends from a closed end to a piston end, the closed end being attached to one of a third member upper end, and a third member lower end.

In Example 5, the height adjustable desk of any one or any combination of Examples 3-4 can optionally be configured to comprise a synchronization assembly configured to balance movement between the first and second members with movement between the second and third members, wherein the synchronization assembly includes a first pulley moveably connected to an upper end of the second member and a second pulley moveably connected to the lower end of the second member.

In Example 6, the height adjustable desk of any one or any combination of Examples 1-5 can optionally be configured such that the wheel is moveably connected to an outer end of the piston.

In Example 7, the height adjustable desk of any one or any combination of Examples 1-6 can optionally be configured such that the wheel and the gas spring are contained within the at least one leg assembly.

In Example 8, the height adjustable desk of any one or any combination of Examples 1-7 can optionally be configured such that the wheel and the gas spring are external to the at least one leg assembly and the wheel and the gas spring are located under the work surface.

In Example 9, the height adjustable desk of any one or any combination of Examples 1-8 can optionally be configured such that the wheel is a first wheel, and wherein the counterbalance mechanism can include: a pulley bracket having one end connected to the gas spring near the first wheel, the pulley bracket having a second wheel at an opposing end of the pulley bracket; and a second tension member engaged to the second wheel.

In Example 10, the height adjustable desk of any one or any combination of Examples 1-9 can optionally be configured such that the second member is configured to fit inside the first member and form a telescoping assembly.

In Example 11, the height adjustable desk of any one or any combination of Examples 1-10 can optionally be configured such that the at least one leg assembly is a first leg assembly, comprising a second leg assembly connected to the work surface, the second leg assembly including: a second leg first member; and a second leg second member moveable relative to the second leg first member along a longitudinal axis.

In Example 12, a lift mechanism can comprise: a first member; and a second member moveable relative to the first member along a longitudinal axis; and a counterbalance mechanism configured to counteract a force exerted on the lift mechanism. The counterbalance mechanism can include: a gas spring having a moveable piston slidably attached to a cylinder, the cylinder attached to the lift mechanism; a wheel moveably connected to an outer end of the piston; and a tension member engaged to the wheel, the tension member having a first end and a second end, the first end attached to the lift mechanism.

In Example 13, the lift mechanism of Example 12 can optionally be configured such that the cylinder extends from a closed end to a piston end, the closed end being attached to one of a first member upper end, a first member lower end, a second member upper end, and a second member lower end.

In Example 14, the lift mechanism of any one or any combination of Examples 12-13 can optionally be configured to comprise a third member moveable relative to the second member along a longitudinal axis.

In Example 15, the lift mechanism of Example 14 can optionally be configured such that the cylinder extends from a closed end to a piston end, the closed end being attached to one of a third member upper end, and a third member lower end.

In Example 16, the lift mechanism of any one or any combination of Examples 14-15 can optionally be configured to comprise a synchronization assembly configured to partially transfer one of: a) movement between the first member and the second member to movement between the second member and the third member, and b) movement between the second member and the third member to movement between the first member and the second member, wherein the synchronization assembly includes a first pulley moveably connected to an upper end of the second member and a second pulley moveably connected to the lower end of the second member.

In Example 17, the lift mechanism of any one or any combination of Examples 12-16 can optionally be configured to comprise a work surface attached to an upper end of the lift mechanism.

In Example 18, the lift mechanism of any one or any combination of Examples 12-16 can optionally be configured such that the second member is configured to fit inside the first member and form a telescoping assembly.

In Example 19, the lift mechanism of any one or any combination of Examples 12-16 can optionally be configured such that the wheel is a first wheel and wherein the counterbalance mechanism can include: a pulley bracket having one end connected to the gas spring near the first wheel, the pulley bracket having a second wheel at the opposing end of the pulley bracket; and a second tension member engaged to the second wheel.

In Example 20, the lift mechanism of any one or any combination of Examples 12-16 can optionally be configured such that the gas spring is a first gas spring, the lift mechanism comprising a second gas spring extending in an opposite direction from the first gas spring.

In Example 21 height adjustable desk or lift mechanism of any one or any combination of Examples 1-20 can optionally be configured such that all elements, operations, or other options recited are available to use or select from.

These and other examples and features of the present height adjustable desk and lift mechanisms will be set forth in part in the following Detailed Description. This Overview is intended to provide non-limiting examples of the present subject matter—it is not intended to provide an exclusive or exhaustive explanation. The Detailed Description below is included to provide further information about the present height adjustable desk and lift mechanisms.

BRIEF DESCRIPTION OF THE DRAWINGS

The following drawings are illustrative of particular examples of the present invention and therefore do not limit the scope of this disclosure. The drawings are not to scale (unless so stated) and are intended for use in conjunction with the explanations in the following detailed description. Examples of the present invention will hereinafter be described in conjunction with the appended drawings, wherein like numerals denote like elements.

DETAILED DESCRIPTION

The following detailed description is exemplary in nature and is not intended to limit the scope, applicability, or configuration of this disclosure in any way. Rather, the following description provides some practical illustrations for implementing exemplary examples of the present invention. Examples of constructions, materials, dimensions, and manufacturing processes are provided for selected elements, and all other elements employ that which is known to those of ordinary skill in the field of this disclosure. Those skilled in the art will recognize that many of the noted examples have a variety of suitable alternatives.

Figure 1:
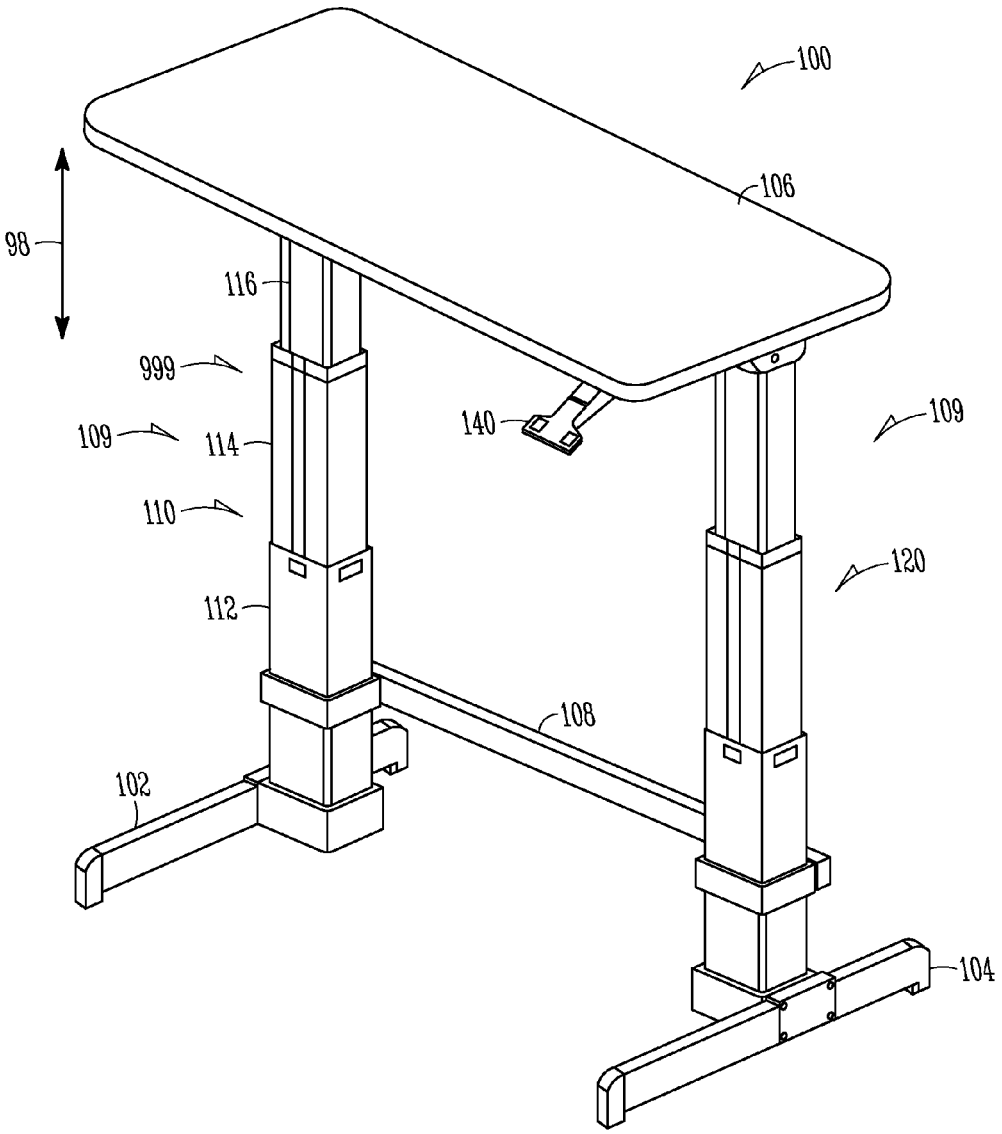
FIG. 1 is a perspective view of a height adjustable desk with leg assemblies in accordance with at least one example of this disclosure.

FIG. 1 is a perspective view of a height adjustable desk 100. The height adjustable desk 100 can include one or more leg assemblies 109 that can support a work surface 106. The work surface 106 can be a table top, a desk surface or other horizontal member. The leg assembly 109 can be used as a lift mechanism 999 that can be used to provide support and counteract a downward force for numerous applications including a work surface 106, table, or desk 100. The height adjustable desk 100 is illustrated including two leg assemblies 109, a first leg assembly 110, and a second leg assembly 120 located under the work surface 106. In this disclosure the words "leg" and "riser" are used interchangeably. Each leg assembly 109 can include two or more tubes or members and in FIG. 1 height adjustable desk 100 is illustrated having three tubes or members: a first member 112, a second member 114 and a third member 116 in a telescopic nested arrangement. Although "telescoping" tubes or members are illustrated and described, non-telescoping configurations of sliding members are also contemplated by this disclosure (see FIG. 32). In another example, each leg assembly can include two tubes (see FIGS. 34-38). In some examples, the first and second leg assemblies 110, 120 can be connected together with a cross bar 108. In other examples, the cross bar 108 may not be needed. Each of the first and second leg assemblies 110, 120 can be attached to a first foot 102 and a second foot 104 respectively at the bottom end of the leg assembly 109. Each leg assembly 109 can be attached to a bottom surface (not shown) of the work surface 106 at the upper end of the leg assembly 109. The feet can add greater stability. One or both leg assemblies 109 can include a brake mechanism 200 (see FIG. 11) to secure the work surface 106 at a desired height. When needed, a user can squeeze a brake handle 140 to unlock the brake mechanism and move the work surface 106 to a second height. Such a movement can be described as a height adjustment 98. When the brake handle 140 is released, the work surface 106 can be secured at the second height. In some examples, a counterbalancing mechanism 151 (see FIGS. 6-8) can be located inside one or more leg assemblies. In other examples, portions of the counterbalancing mechanism can be located under the work surface 106 and external to either leg assembly 109.

Figure 2A:
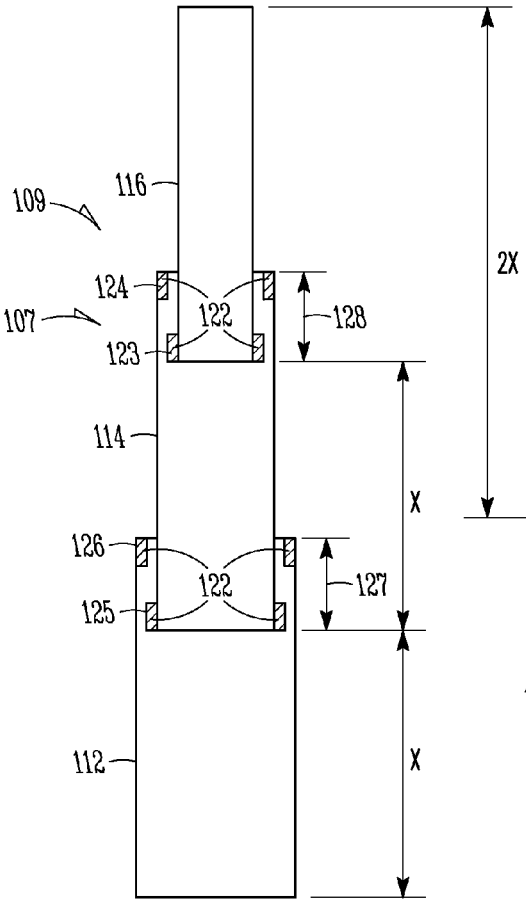
FIGS. 2A-2B are side elevation views of leg assemblies in accordance with at least one example of this disclosure.
Figure 2B:
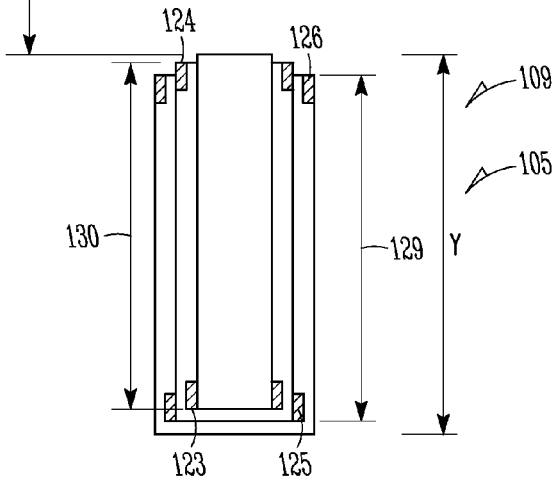

FIGS. 2A and 2B illustrate a leg assembly 109 of a height adjustable desk 100 (see FIG. 1) according to one example of this disclosure. FIG. 2A shows the leg assembly 109 with three telescoping tubes in an extended position 107, and FIG. 2B shows the three telescoping tubes in a collapsed position 105. In this application tubes can also be referred to as "members". The three member leg assembly 109 can include a first member 112, a second member 114 and a third member 116 and the first, second and third members, 112, 114, 116 can be tubular in cross-section, and they can have any cross-sectional shape including but not limited to round, square, rectangular, oval or other profiles. The second member 114 can be slidably engaged with the first member 112, and the third member 116 can be slidably engaged with the second member 114. Although the leg assembly 109 is illustrated with the first member 112 at the bottom and the second member 114 sliding into the first member 112, the leg assembly 109 can be reversed and have the narrowest member at the bottom and larger members sliding over each other (see FIG. 7A-B). The movement or sliding of each member relative to an adjacent member can be synchronized as described in the following paragraphs. If the second member 114 slides X distance relative to the first member 112, then the third member 116 can also slide X distance relative to the second member 114, and total travel for the third member 116 relative to the first member 112 can be equal to 2X distance. In the collapsed position 105, the tubes/members can nest inside one another providing a smaller overall height "Y". In the extended position 107, the second member 114 can extend out of the first member 112, and the third member 116 can extend out of the second member 114.

The tubes/members can include glides 122 (described in more detail below) that can be located between each member at certain locations to provide smooth gliding between the first, second and third members, 112, 114, 116, and to provide structural support for a height adjustable desk 100 (see FIG. 1) to prevent any undesired wobble. In this disclosure, the term "glide" can also be described as a "guide". A set of glides 122 can be attached to a third member bottom outer edge 123, a second member top inner edge 124, a second member bottom outer edge 125, and a first member top inner edge 126 as illustrated in FIG. 2A according to an example of this disclosure. However, other glide orientations are also possible. In some configurations, vertical slides can be used between members instead of glides 122. In the extended position 107, a distance between adjacent glides 122 can be the smallest. The extended position 107 can provide a first minimum overlap 127 between the adjacent glides 122 at the second member bottom outer edge 125 and the first member top inner edge 126. The extended position 107 can provide second minimum overlap 128 between the adjacent glides 122 at the third member bottom outer edge 123 and the second member top inner edge 124.

In the collapsed position 105, adjacent glides 122 can move away from each other. This can provide a maximum distance between the adjacent glides 122, and the collapsed position 105 can provide a first maximum overlap 129 between the adjacent glides 122 at the second member bottom outer edge 125 and the first member top inner edge 126. The collapsed position 105 can provide second maximum overlap 130 between the adjacent glides 122 at the third member bottom outer edge 123 and the second member top inner edge 124. In the collapsed position 105, telescoping members of the leg assembly 109 nest inside one another, and provide the smallest overall height Y of the leg assembly 109. Such a configuration can be advantageous because lower work surface heights can be achievable without decreasing the overlap between the members or without reducing the distance of total height adjustment for the work surface 106 (see FIG. 1). Distance X can be a travel distance of the third member 116 relative to the second member 114 and also a similar distance X can be the travel of the second member 114 relative to the first member 112. Distance 2X can be the travel distance of the third member 116 relative to the first member 112.

Figure 3:
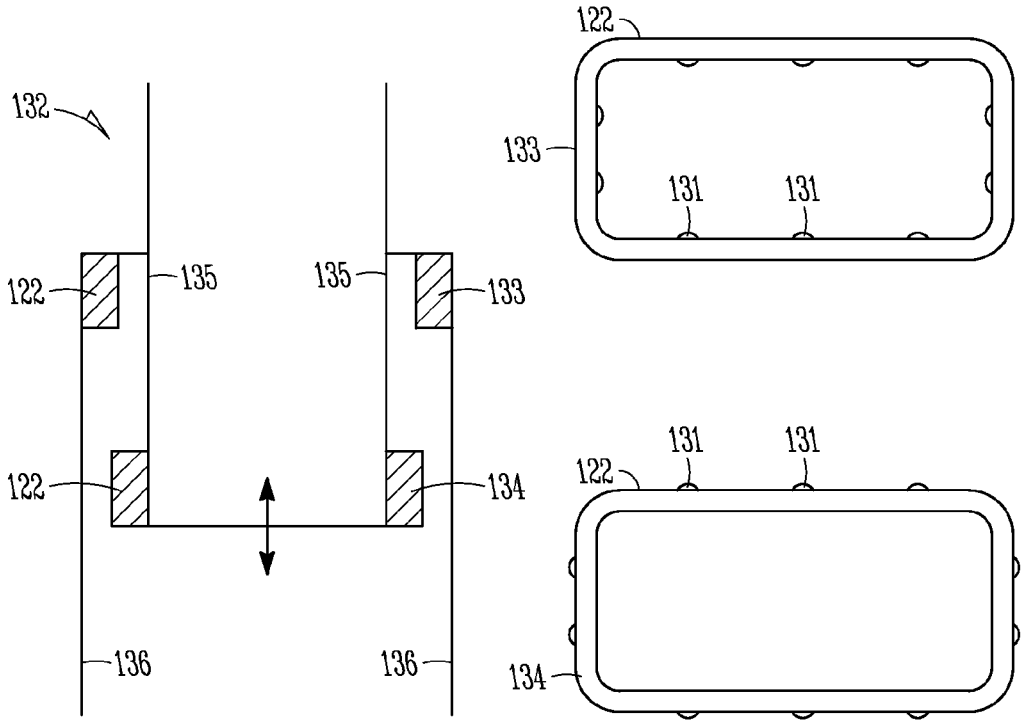
FIG. 3 is a cross-section side elevation view and top plan views of a leg assembly in accordance with at least one example of this disclosure.

FIG. 3 illustrates glides 122 for upper and lower telescoping members 132 in accordance with at least one example of this disclosure. Glides 122 can be made of one-piece molded plastic. However, in some configurations, multiple pieces of molded plastic glides, or tapes made up of low friction materials such as Teflon can be used as gliding surfaces between the adjacent telescoping members. Molded plastics can include bumps 131 to provide smaller contact surfaces between the telescoping members 132 to lower the friction as illustrated in FIG. 3. Grease can be used over the gliding surfaces to reduce friction. In other configurations, glides 122 can be replaced by vertical slides to guide the telescoping members 132 relative to each other. In an example, cross-sectional configurations of an outer glide 122 and an inner glide 122 can include a rectangular shape. In another example, cross-sectional configurations of glides 122 can match any curved, oval, polygonal, or irregular shape of a tube/member. The inner glide 133 can be attached to an inner surface of an outer tube 136, while an outer glide 134 can be attached to the outer surface of an inner tube 135. The bumps 131 can engage a gliding surface of an adjacent tube.

Figure 4:
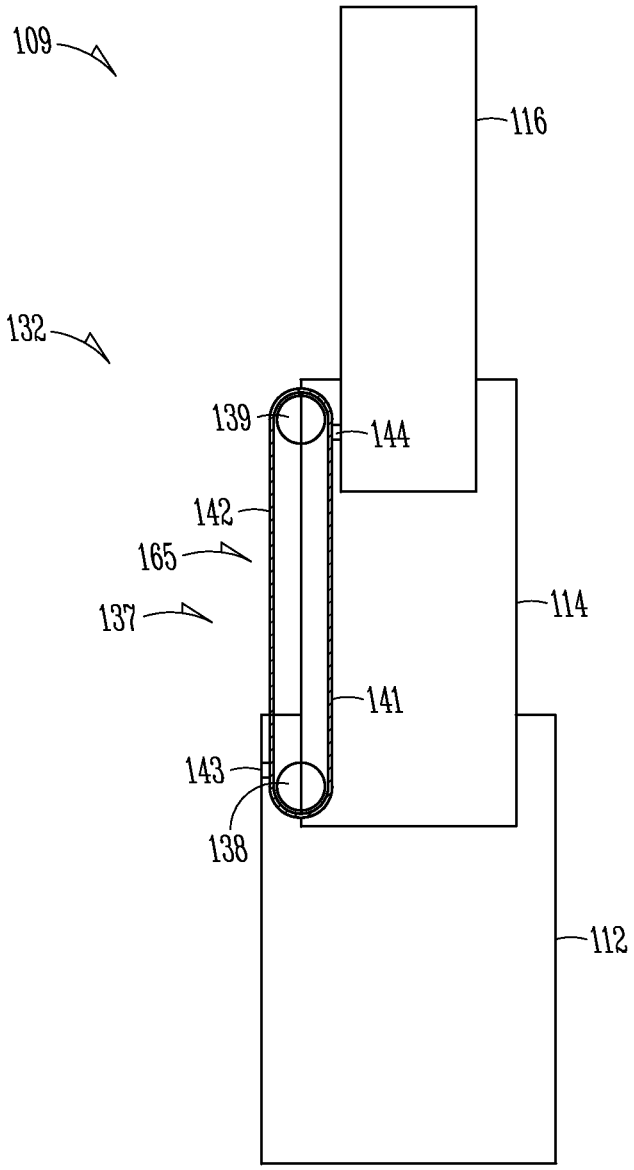
FIG. 4 is a cross-section side elevation view of a leg assembly in accordance with at least one example of this disclosure.

FIG. 4 illustrates a side view of a three member leg assembly 109 having a synchronization assembly 165 including an idler pulley assembly 137 in accordance with at least one example of this disclosure. An idler pulley assembly 137 can include a first idler pulley 138 and a second idler pulley 139, and a first tension member 141 and a second tension member 142. Tension members can be a flexible longitudinal connecting element such as rope, chain, cable, or belting. Tension members can be manufactured from metals, metal alloys, polymers, rubber, leather, fibers or combinations of the previous materials. Telescoping members 132 of the leg assembly 109 can be connected to each other via the idler pulley assembly 137 to ensure that second and third members 114, 116 move in synchronization, and to ensure that the second and third members 114, 116 do not slip relative to each other. Both the first and second idler pulleys 138, 139 can be rotatingly coupled to the second member 114. A first tension member 141 can be routed around the first idler pulley 138 and can be attached to the first member 112 on one end at a first crimp 143 location, and can be attached to the third member 116 on the other end at a second crimp 144 location. A second tension member 142 can be routed around the second idler pulley 139 and can be attached to the first member 112 on one end at the first crimp 143 locations, and attached to the third member 116 on the other end at the second crimp 144 location. The configuration shown in FIG. 4 is for illustrative purposes only and should not be construed as limiting this disclosure. The idler pulleys 138, 139 can be attached to the second member 114 in many different locations to satisfy the geometric restrictions of the design. In some configurations, the first tension member 141 and the second tension member 142 can be portions of one continuous loop, and the one continuous loop can be attached to the first member 112 and third member 116 at the first crimp 143 and the second crimp 144 locations, respectively. In other configurations, the idler pulleys 138, 139 can be located on opposite sides of the telescoping members 132, and the first crimp 143 and second crimp 144 locations can be different for the first tension member 141 and the second tension member 142.

Figure 5A:
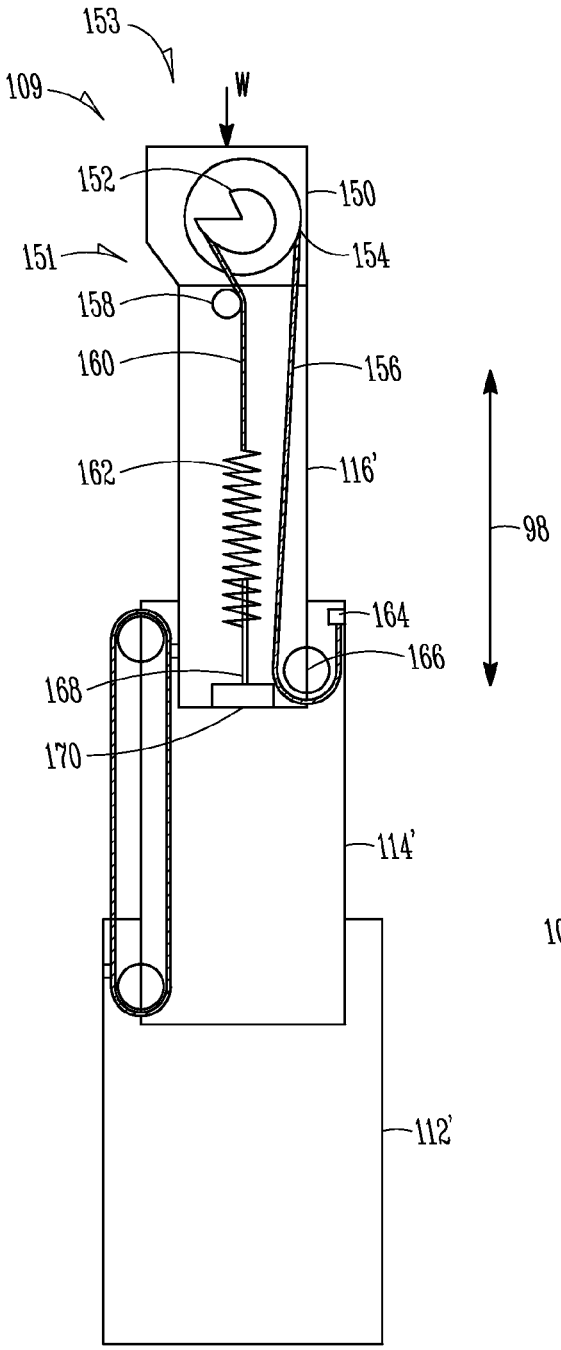
FIGS. 5A-5B are cross-section side elevation views of a leg assembly with a counterbalance mechanism in accordance with at least one example of this disclosure.
Figure 5B:
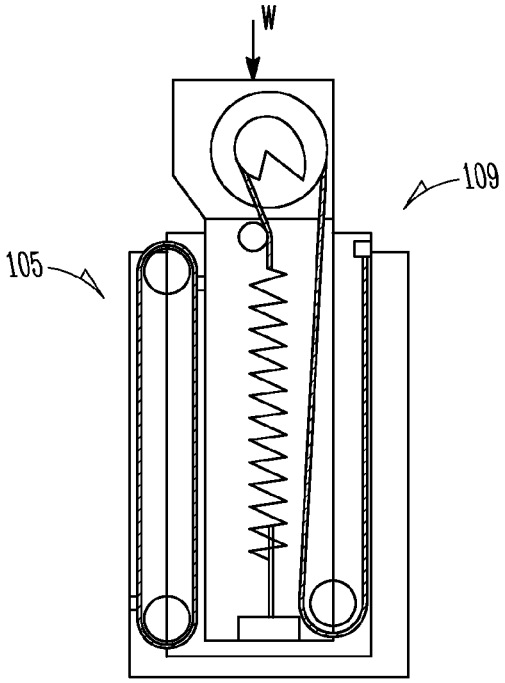

FIGS. 5A and 5B show a counterbalance mechanism 151 according to an example of this disclosure. A counterbalance mechanism 151 can be a combination of one or more energy storage members, one or more wheels/pulleys and one or more tension members. A counterbalance mechanism 151 can provide a force to counteract a force created by the weight of a work surface 106 (see FIG. 1) and any components such as documents, computers, tools, books etc. that may be supported by the work surface 106. The energy storage member can be a gas spring, a rubber strap, a resilient member, or spring. The spring can be an extension spring or a compression spring. In the alternative, a counterbalance mechanism can have a force providing device which can function essentially as an energy storage member such as an electric motor, a linear actuator, a hydraulic actuator, or other similar devices. In this disclosure, although a coil spring or gas spring may be illustrated or described; other energy storage members or force providing devices can be substituted without changing the general intent of this disclosure. A leg assembly 109 can include three nesting members such as a lower tube 112', a middle tube 114' and an upper tube 116'. A cam/wheel assembly 153 can be attached close to the top end of the upper tube 116'. A cam housing 150 can be located on top of the upper tube 116' and can at least partially contain the cam/wheel assembly 153. An idler pulley 166 can be attached close to the bottom end of the upper tube 116'. A wheel tension member 156 can be routed around the idler pulley 166 and it can be attached to the middle tube 114' at a third crimp 164 on one end, and attached to the wheel 154 on the other end. A spring 162 can be located approximately in the middle of the upper tube 116'. A bottom end of the spring 162 can be attached to an adjustment screw 168. The adjustment screw 168 can be attached to a spring adjustment assembly 170 at the other end. The spring adjustment assembly 170 can be fixed to the upper tube 116'. A first end of a cam tension member 160 can be connected to the top end of the spring 162. The cam tension member 160 can be routed around the tension member routing pulley 158 and connected to the cam 152 on a second end of the cam tension member 160.

At the top of the travel range when the tubes are extended as illustrated in FIG. 5A, the wheel tension member 156 can be wrapped around the wheel 154. There can be a small extension of the wheel tension member 156 between the idler pulley 166 and the third crimp 164. As the upper tube 116' moves downwardly relative to the middle tube 114', the length of the wheel tension member 156 between the idler pulley 166 and the third crimp 164 can increase. If a weight "W" acts on the work surface 106 of height adjustable desk 100 (see FIG. 1), the counterbalance mechanism 151 located inside the upper tube 116' can resist the downward force due to the weight "W", and prevent relative motion between the upper tube 116' and middle tube 114'. During a height adjustment 98, as the upper tube 116' moves relative to the middle tube 114', the section of the wheel tension member 156 between the idler pulley 166 and the third crimp 164 extends by allowing the wheel 154 to rotate and unwrap the wheel tension member 156. Since the cam 152 and the wheel 154 are attached together, the cam 152 also rotates, and thus, the cam tension member 160 wraps around the cam 152 and pulls the upper end of the spring 162 upwards, and stretches the spring 162, which can cause a greater spring tension.

Figure 6A:
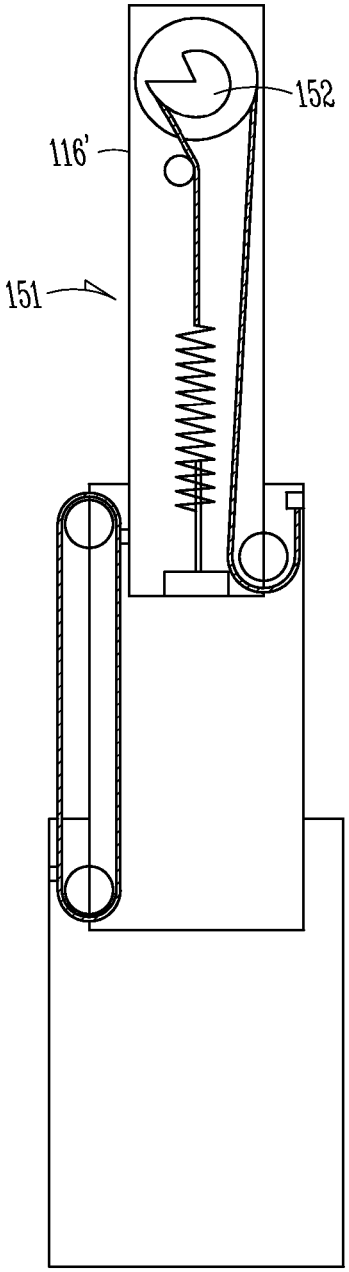
FIGS. 6A-6B are cross-section side elevation views of a leg assembly with a counterbalance mechanism in accordance with at least one example of this disclosure.
Figure 6B:
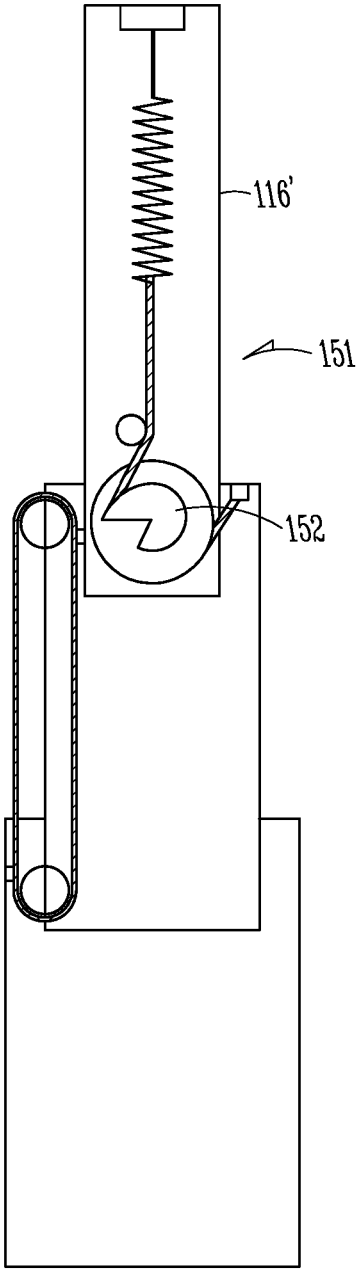
Figure 7A:
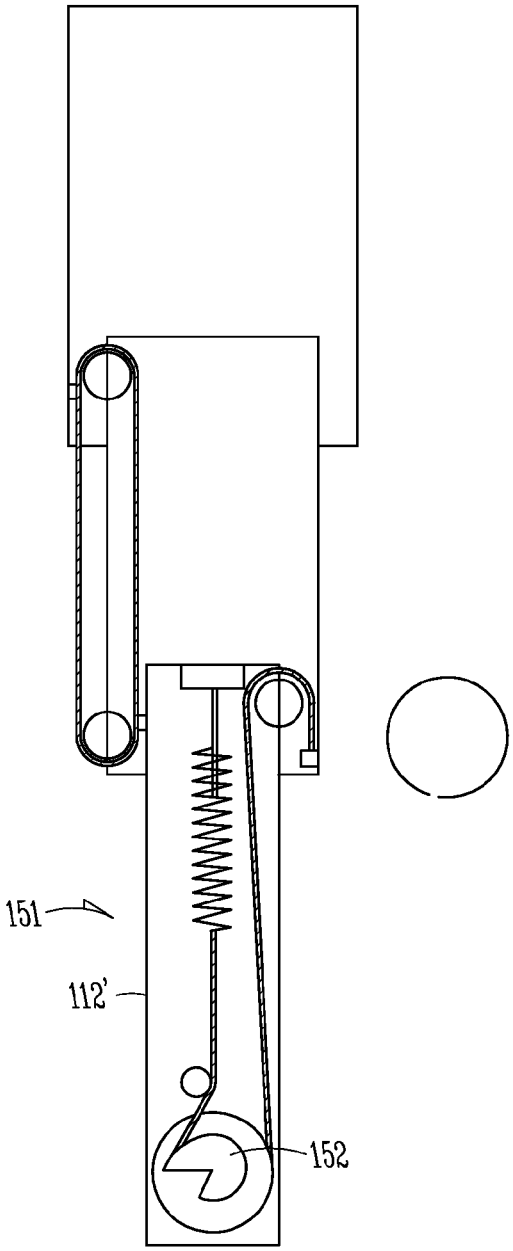
FIGS. 7A-7B are cross-section side elevation views of a leg assembly with a counterbalance mechanism in accordance with at least one example of this disclosure.
Figure 7B:
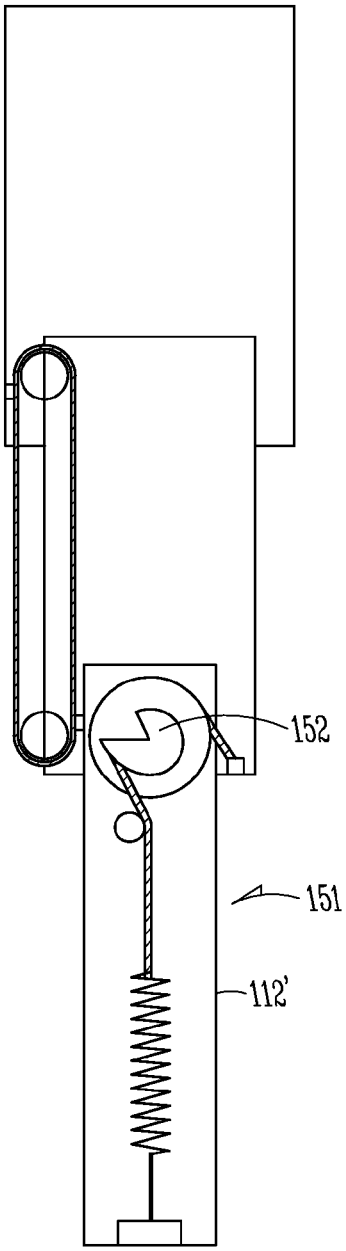
Figure 8A:
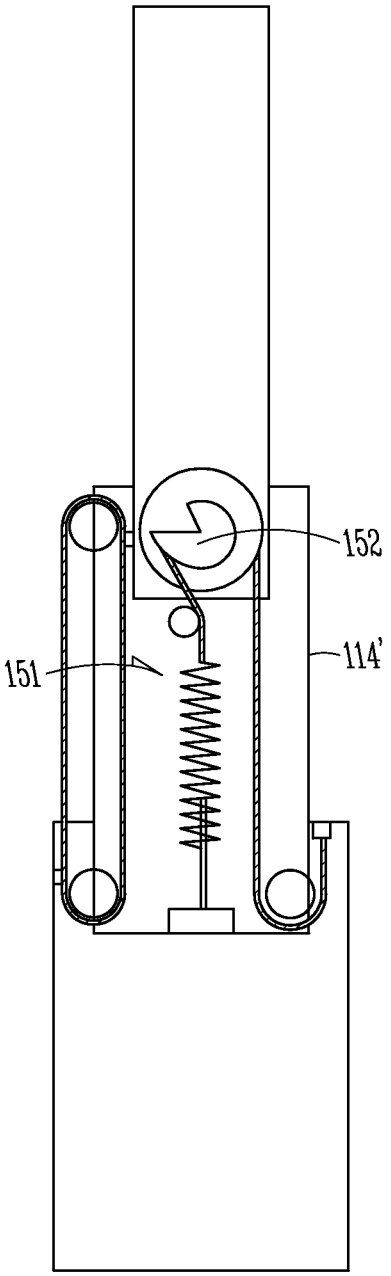
FIGS. 8A-8B are cross-section side elevation views of a leg assembly with a counterbalance mechanism in accordance with at least one example of this disclosure.
Figure 8B:
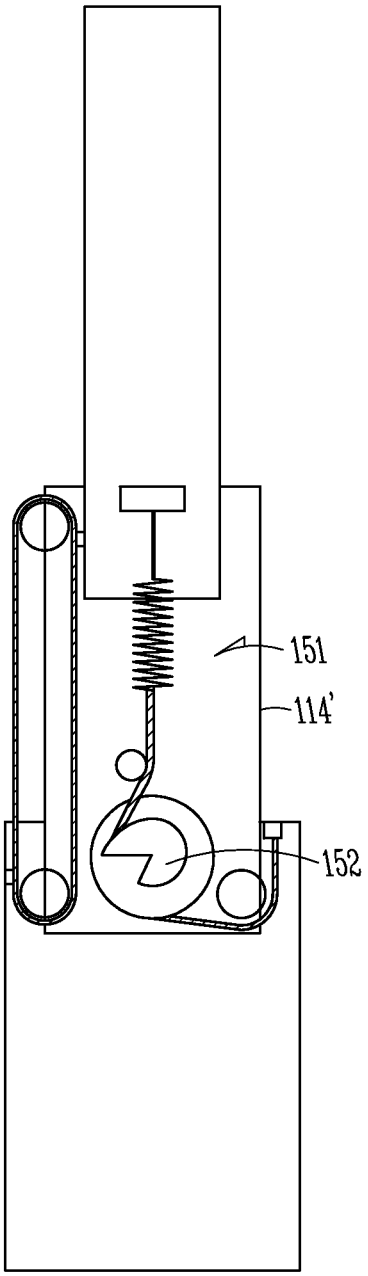

As illustrated in FIG. 5B, in the collapsed position, as the spring force increases, the cam radius decreases to provide a constant torque around the wheel/cam assembly. The torque balance provides a constant force lift. This method of weight counterbalance using rotary cam is also explained in the patent, U.S. Pat. No. 8,286,927, the relevant contents of which are hereby incorporated by reference. In some examples, the counterbalance mechanism 151 can be completely positioned inside the upper tube 116' as illustrated in FIG. 6A-B. In some examples, the counterbalance mechanism 151 may also be included inside the lower tube 112' (as illustrated in FIG. 7A-B) or middle tube 114' (as illustrated in FIG. 8A-B) in other configurations. FIG. 7A-B illustrate examples of a set of telescoping tubes having a smaller diameter tube at the base and a larger diameter tube at the upper end. The cam 152 can be located on the upper end of the tube (as illustrated in FIGS. 6A, 7B, and 8A), or on the lower end of the tube (as illustrated in FIGS. 6B, 7A, and 8B).

Figure 9A:
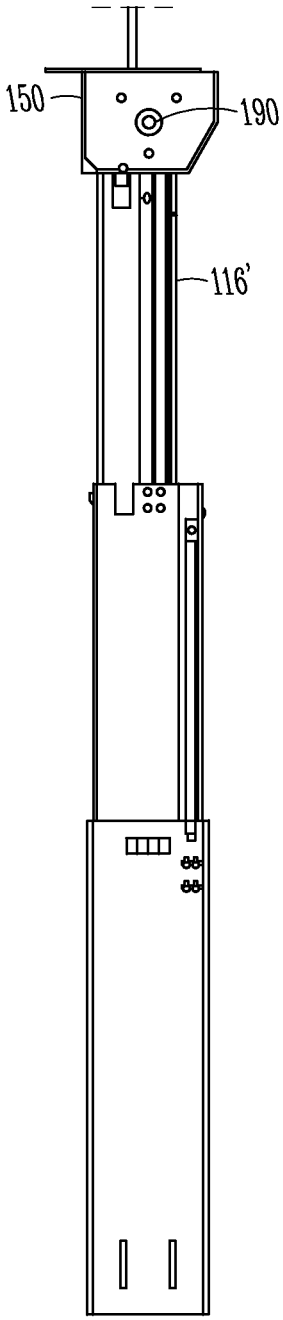
FIGS. 9A-9B are side elevation views of a leg assembly with a counterbalance mechanism comprising a cam housing in accordance with at least one example of this disclosure.
Figure 9B:
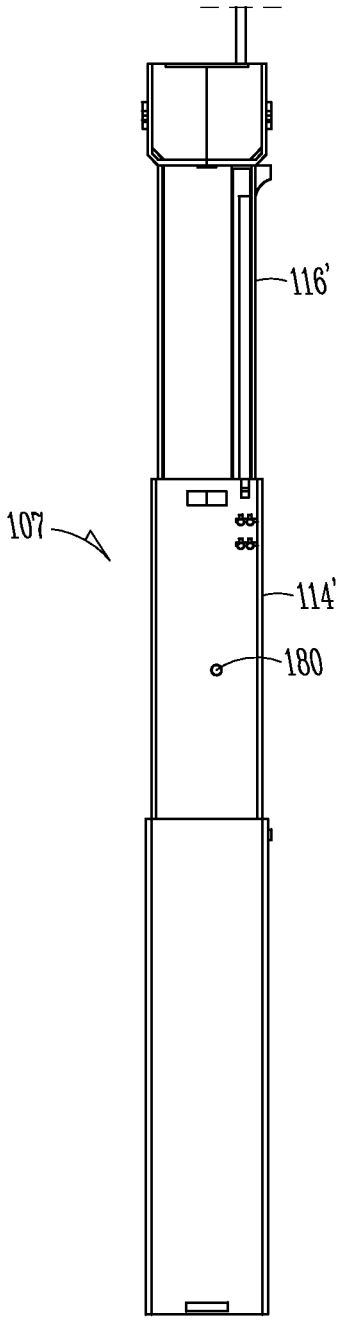

FIG. 9 shows a leg assembly according to an example of this disclosure. The cam housing 150 can be located on top of the upper tube 116'. A cam axle 190 can be exposed on one side of the cam housing 150. The cam axle 190 can be used to synchronize the cam/wheel rotations if both the leg assemblies 110, 120 (see FIG. 1) are used to provide the height adjustment 98 (see FIG. 5A).

Figure 10:
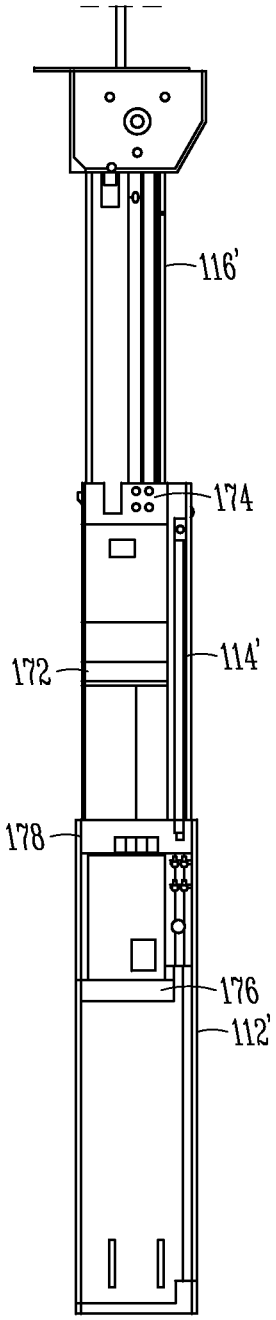
FIG. 10 is a cross-section of a side elevation view of a leg assembly in accordance with at least one example of this disclosure.

FIG. 10 shows a guide structure for the leg assemblies according to an example of this disclosure. The guides can be molded components. They provide smooth low friction surfaces between the tubes. In some configurations, vertical slides may be used. The middle and lower tubes 114', 112' are shown as transparent to expose the guide members 172, 174, 176, 178. An upper tube guide member 172 can be located near the bottom end of the upper tube 116'. A top middle tube guide member 174 can be located near the top of the middle tube 114'. A bottom middle tube guide member 176 can be located near the bottom of the middle tube 114'. A lower tube guide member 178 can be located near the upper end of the lower tube 112'.

Figure 11:
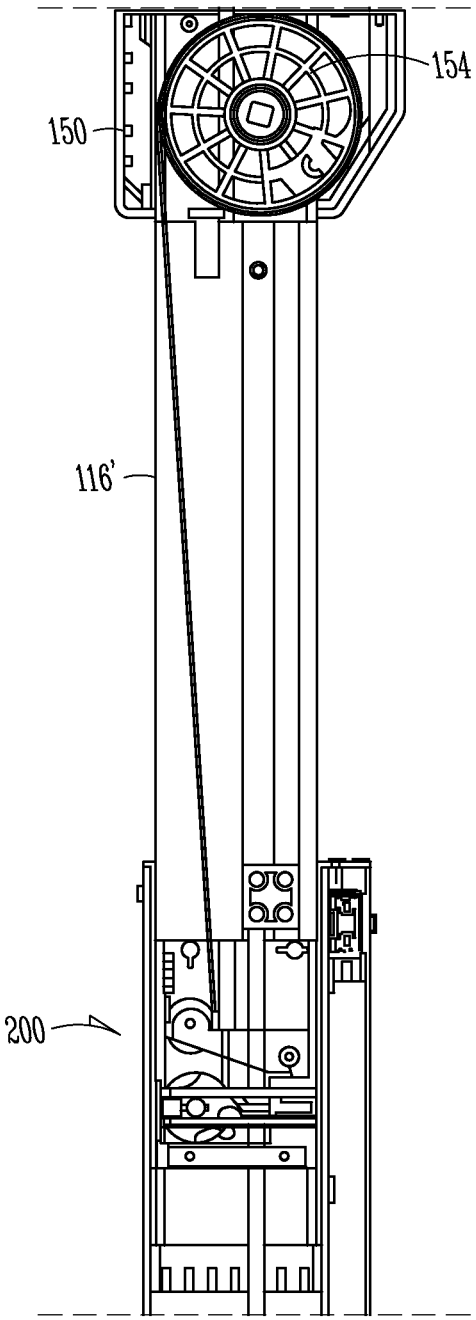
FIG. 11 is a cross-section of a side elevation view of a leg assembly with a brake mechanism in accordance with at least one example of this disclosure.

FIG. 11 shows an upper tube assembly. The cam housing 150 including the wheel 154 can be attached to the top of the upper tube 116'. A brake assembly 200 can be located at the bottom of the upper tube 116' as in the example shown, however other positions in a leg assembly 109 (see FIG. 1) are possible for a brake assembly 200.

Figure 12:
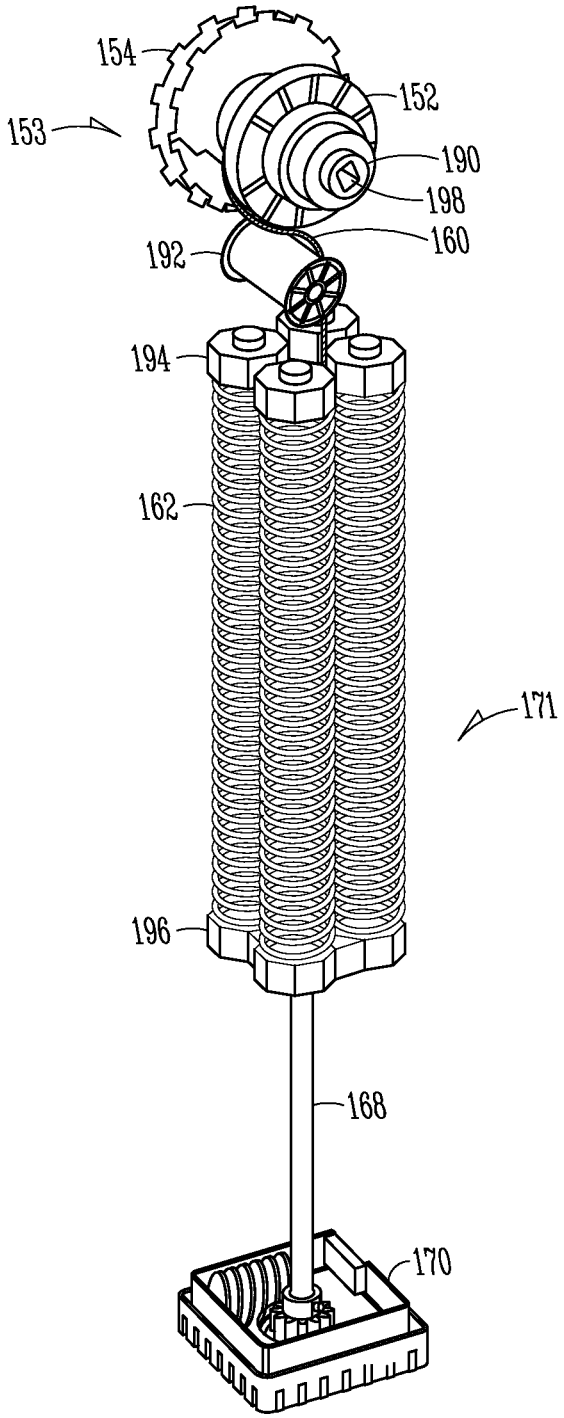
FIG. 12 is a perspective view of a spring adjustment assembly in accordance with at least one example of this disclosure.

FIG. 12 illustrates a perspective view of a spring assembly 171. The cam/wheel assembly 153 can be located inside a cam housing 150 as in FIG. 5. The rest of the components, including the mandrel 192, springs 162, and spring adjustment assembly 170 can be located inside the upper tube 116'. In another example, all of the components can be located within members of a leg assembly 109 (see FIG. 1). Depending on the lift force requirement, a number of springs may be used in the spring assembly 171. The number of springs 162 can vary, e.g., between 1 and 4. In some examples, four or more springs 162 may be included. The upper spring holding block 194 can be attached to the upper end of the springs 162, and the lower spring holding block 196 can be attached to the lower end of the springs 162. One or more cam tension members 160 may be attached to the upper spring holding block 194. These tension members are routed around the mandrel 192 and attached to one or more cams 152. In some examples, if only one spring 162 is used, the upper spring holding block 194 can be eliminated, and the cam tension member 160 can be directly attached to a hook (not shown) at the end of the spring 162. The lower spring holding block 196 has a threaded hole (not shown) at the center. An adjustment screw 168 can be threadingly engaged with the lower spring holding block 196 through this hole. The bottom end of the adjustment screw 168 can be attached to the spring adjustment assembly 170. By rotating the adjustment screw 168 via the spring adjustment assembly 170, it can be possible to pull the bottom end of the springs 162 down and increase the spring tension to counterbalance a larger weight.

Figure 13A:
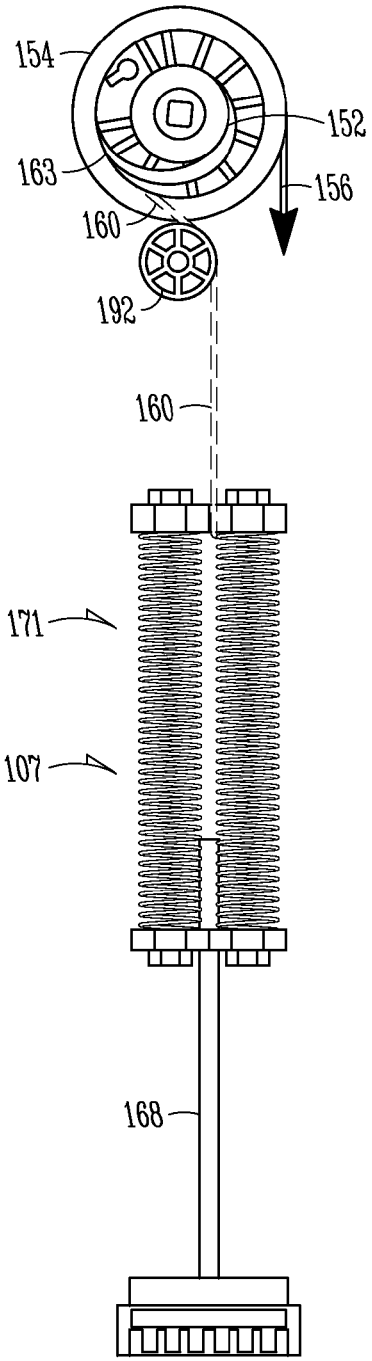
FIGS. 13A-C are front elevation views of a spring adjustment assembly in accordance with at least one example of this disclosure.
Figure 13B:
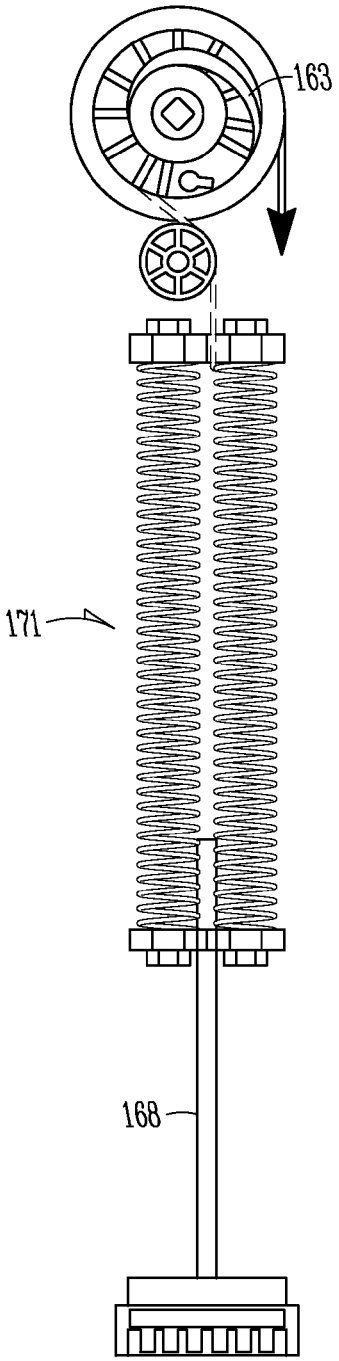
Figure 13C:
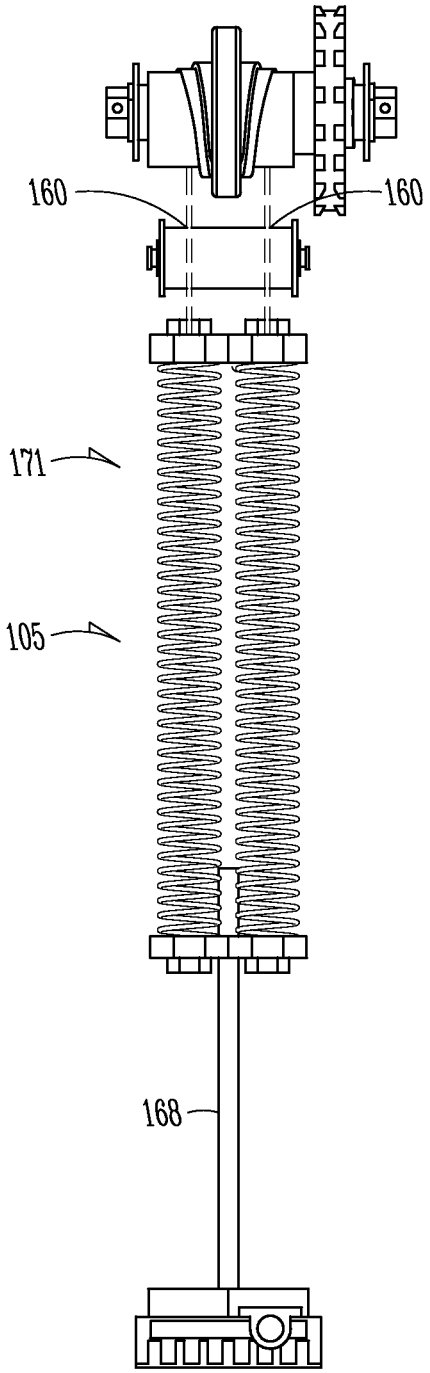

FIG. 13A illustrates adjustment of the spring assembly 171 for the minimum weight, when the desk leg assemblies can be in an extended position 107 (see FIGS. 2A, 5A). There is no cam rotation yet, and therefore, upper end of the spring assembly 171 is not stretched towards the cam 152. At this orientation, the cam tension member 160 can be in contact with the starting point of a cam profile 163. The cam profile 163 can be an eccentric shape that can be designed to allow smoothly operating height adjustments. As the leg assemblies 109 (see FIG. 1, 3) are compressed, the wheel/cam assembly rotates, and the cam tension member 160 can be wrapped around the cam 152, and the upper end of the spring assembly 171 can be pulled up as shown in FIG. 13B. As the cam tension member 160 wraps around the cam 152, the wheel tension member 156 can be moving in the opposite direction. FIG. 13C shows the side view of the spring assembly 171 at the collapsed position 105 of the tubes 112', 114', 116' (see FIGS. 2B, 5B). As shown in the side view of FIG. 13C, the spring assembly 171 can include multiple cam tension members 160 and a cam 152 can be configured for more than one cam tension member 160. The adjustment screw 168 can be at an extended length as in FIGS. 13A-C.

Figure 14A:
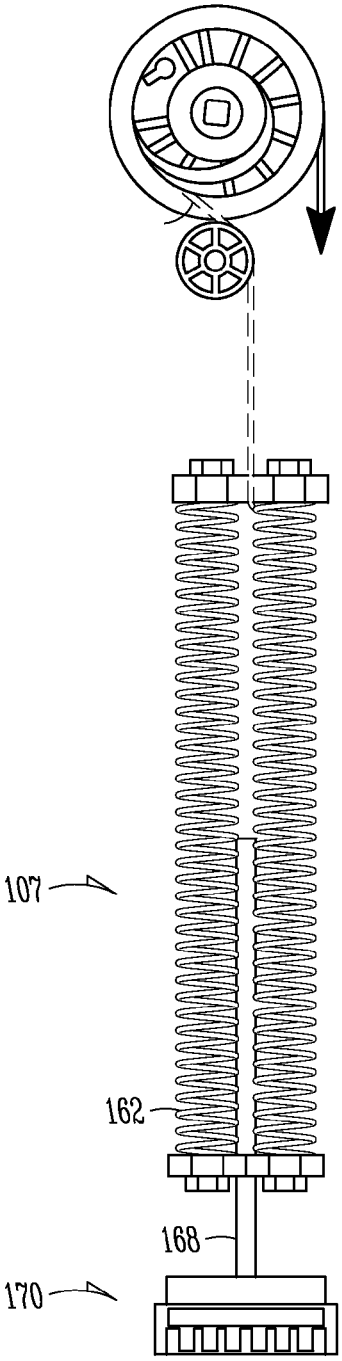
FIGS. 14A-B are front elevation views of a spring adjustment assembly in accordance with at least one example of this disclosure.
Figure 14B:
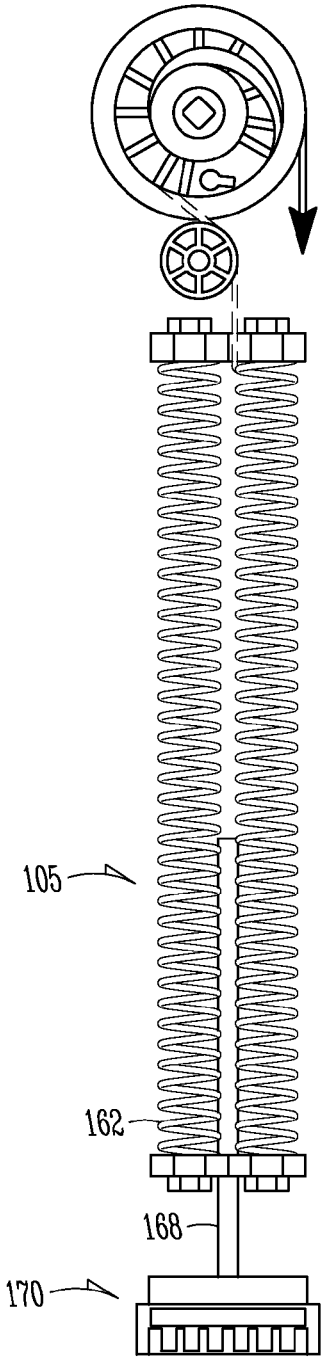

FIGS. 14A-B are front elevation views of a spring adjustment assembly 170 in accordance with at least one example of this disclosure. To counterbalance larger weights, the lower end of the springs 162 can be pulled down by turning the adjustment screw 168 as shown in FIGS. 14A and 14B, for extended position 107 and collapsed position 105 of the leg assemblies 109, respectively (see FIGS. 2A-B, 5A-B).

Figure 15:
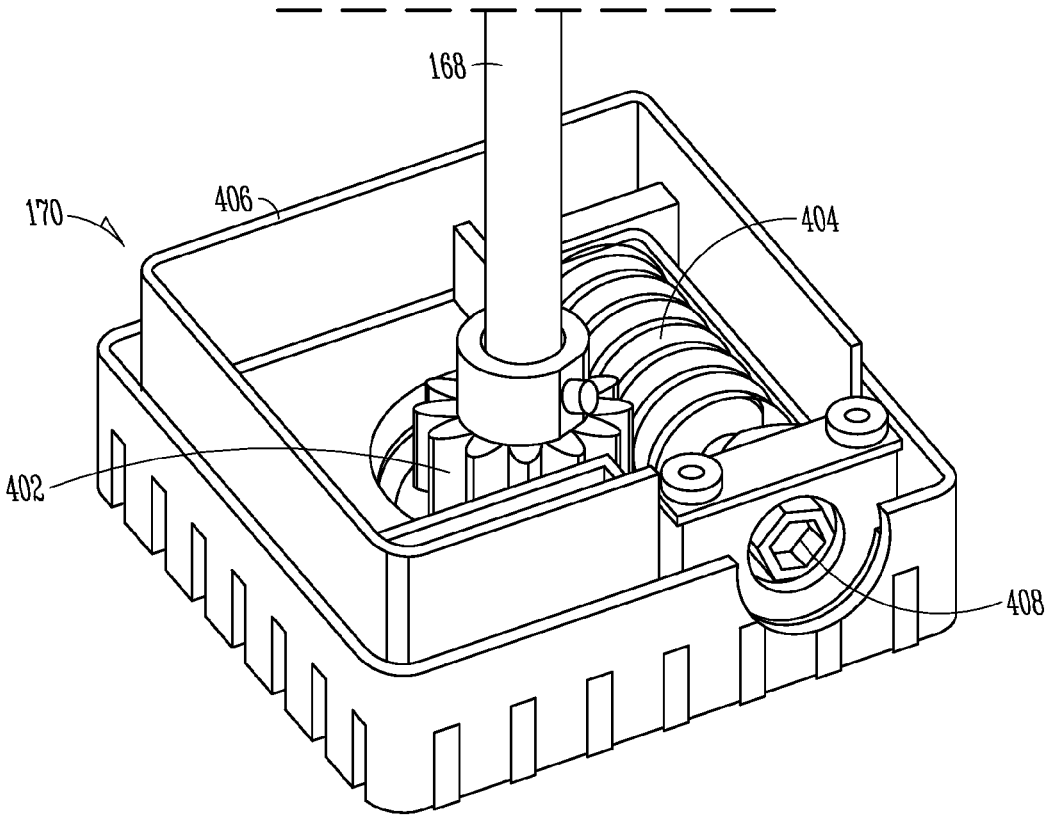
FIG. 15 is a perspective view of selected details of a spring adjustment assembly in accordance with at least one example of this disclosure.

FIG. 15 is a perspective view of selected details of a spring adjustment assembly 170 in accordance with at least one example of this disclosure. All the components are attached to a cast block 406, and the block 406 can be attached to the bottom end of the upper tube 116' (see FIG. 5A). The bottom end of the adjustment screw 168 can be attached to a gear 402. The gear 402 can be operably coupled to a worm gear 404. One end of the worm gear 404 has a recessed hole 408. The shape of the hole 408 can be hexagonal. The hole 408 can be in line with an access hole 180 located on the middle tube 114' at a certain position of the first and second leg assemblies 110, 120. The position of the access hole 180 is shown in FIG. 9. The recessed hole 408 can be in line with the access hole 180 at the extended position 107 of the first and second leg assemblies 110, 120 (see FIG. 1) since this also corresponds to the lowest spring tension. By accessing the recessed hole 408 and turning the worm gear 404 using a tool (e.g.: a wrench), a user can increase or decrease the tension on the extension springs 162 (see FIGS. 14A-B), and increase or decrease the lift capacity of the counterbalance mechanism 151 (see FIGS. 5, 13, 14).

Figure 16:
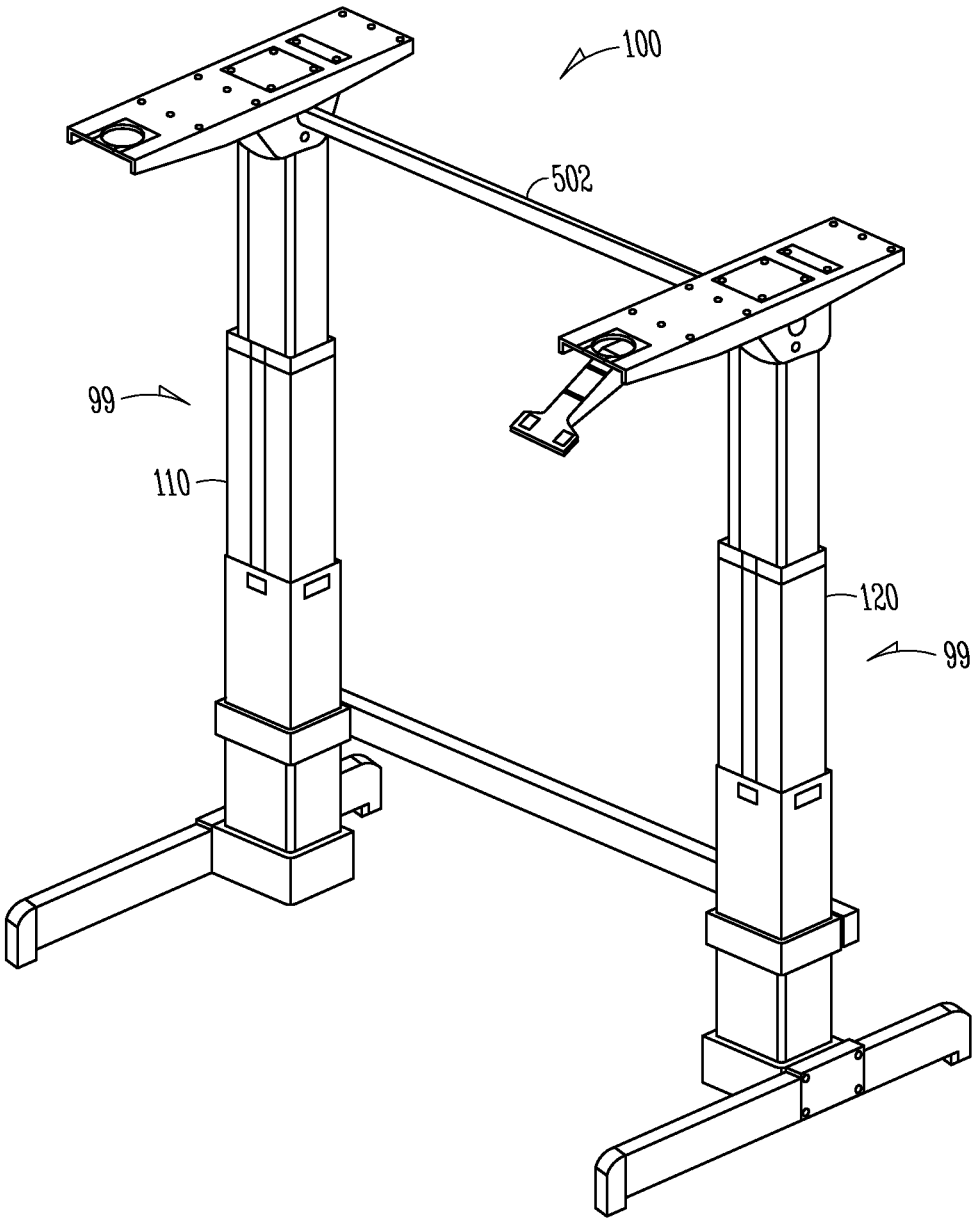
FIG. 16 is a perspective view of a height adjustable desk with leg assemblies in accordance with at least one example of this disclosure.
Figure 17:
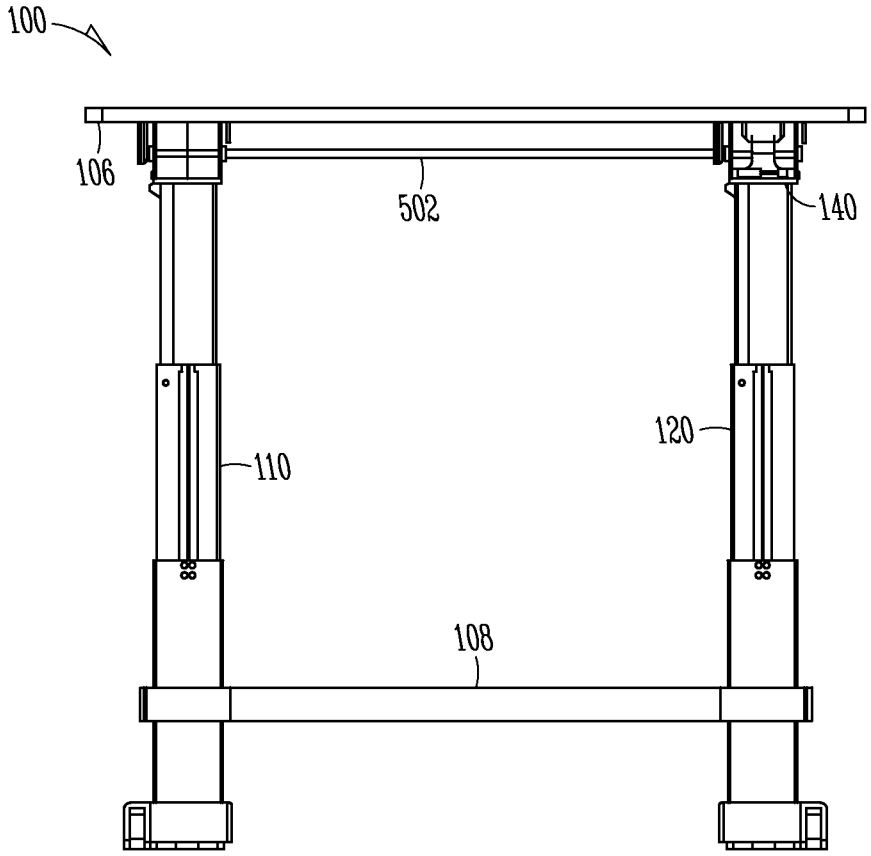
FIG. 17 is a front elevation view of a height adjustable desk with leg assemblies in accordance with at least one example of this disclosure.

FIG. 16 is a perspective view of a height adjustable desk 100 with leg assemblies 99 in accordance with at least one example of this disclosure. In some examples, a synchronization bar 502 can be provided as shown in FIG. 16. When more than one leg assembly 99 is used to lift the desk surface, the wheel rotations can be synchronized by the synchronization bar 502 on the first and second leg assemblies 110, 120 so that both leg assemblies extend or collapse to the same amount to keep the desk surface horizontal. The synchronization bar 502 can be inserted into a square recessed hole 198 located on the cam axle 190 of each lift mechanism. The square recessed hole 198 can be best seen in FIG. 12. A front view of a height adjustable desk 100 including a work surface 106, a synchronization bar 502, a brake handle 140, first and second leg assemblies 110, 120 each including three telescoping tubes and a cross bar 108 is shown in FIG. 17.

Figure 18:
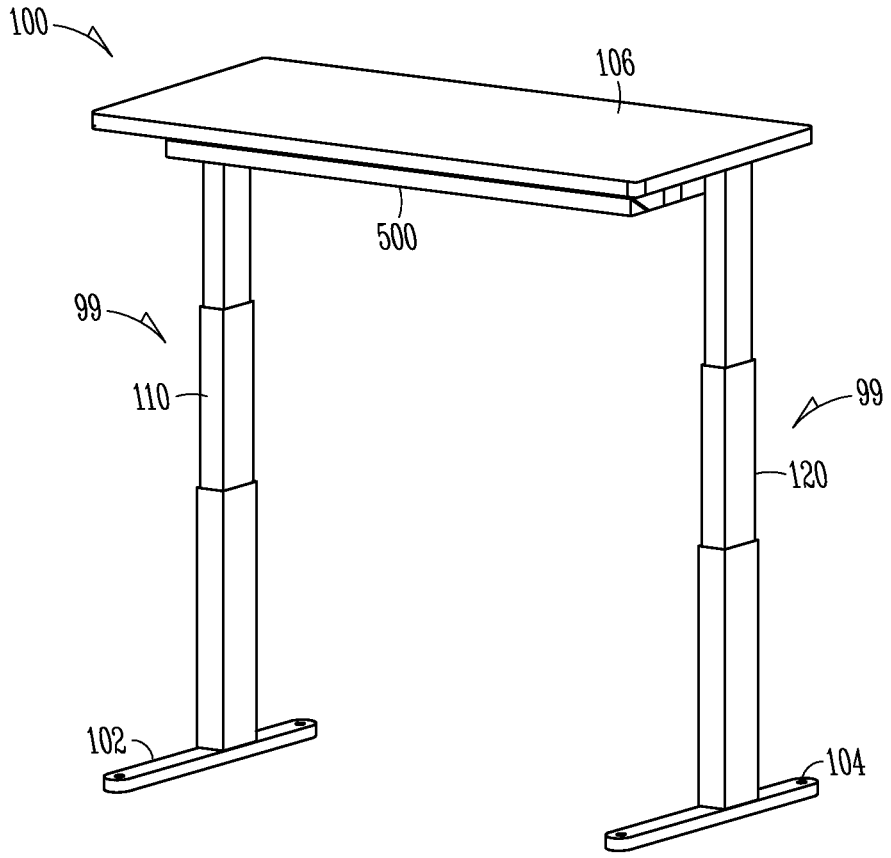
FIG. 18 is a perspective view of a height adjustable desk with leg assemblies in accordance with at least one example of this disclosure.
Figure 19:
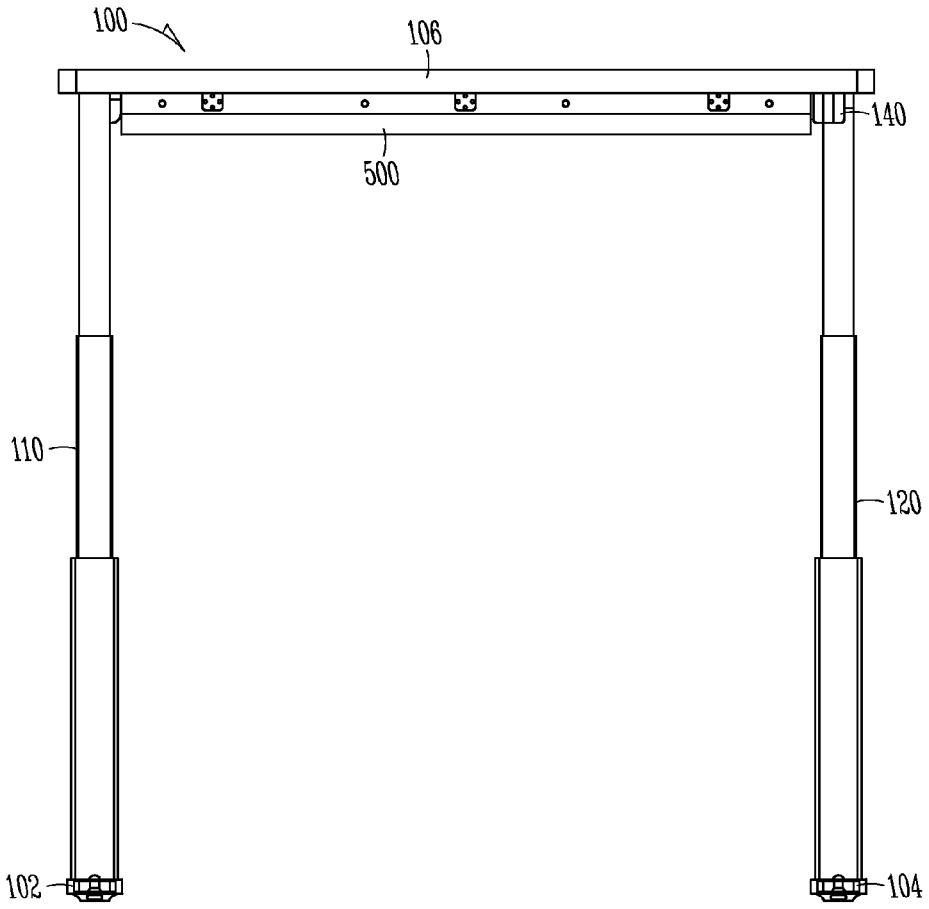
FIG. 19 is a front elevation view of a height adjustable desk with leg assemblies in accordance with at least one example of this disclosure.

FIG. 18 is a perspective view of a height adjustable desk 100 with leg assemblies 99 in accordance with at least one example of this disclosure. In this configuration, the counterbalance mechanism 500 is attached to the bottom of the work surface 106. The first and second leg assemblies 110, 120 can include a synchronization assembly 165 (see FIG. 4) for the telescoping tubes. A front view of the same height adjustable desk 100 is shown in FIG. 19.

Figure 20:
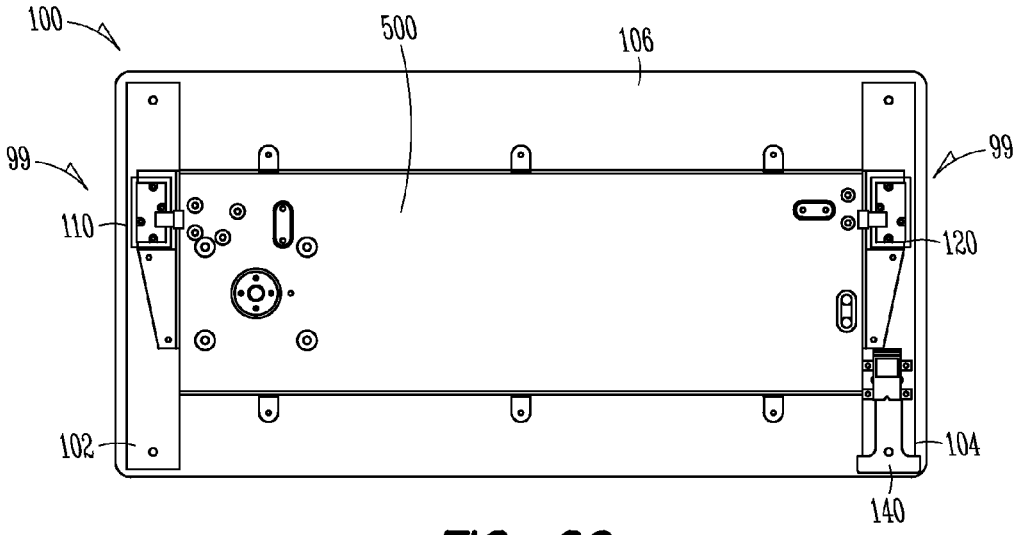
FIG. 20 is a bottom plan view of a height adjustable desk with leg assemblies in accordance with at least one example of this disclosure.

FIG. 20 is a bottom plan view of a height adjustable desk 100 with leg assemblies 99 in accordance with at least one example of this disclosure. FIG. 20 illustrates main subassemblies of the height adjustable desk 100 with the counterbalance mechanism 500 located under the height adjustable desk 100. The work surface 106 is shown as transparent to make the rest of the components visible. The counterbalance mechanism 500, as shown, can be contained inside a metal box which can be attached to the bottom of the work surface 106. First and second leg assemblies 110, 120 can be attached to left and right sides of the work surface 106 close to the edges. A brake handle 140 can be located under the desk surface close to a front right corner. First and second foot 102, 104 are shown at the base of the leg assemblies 99

Figure 21:
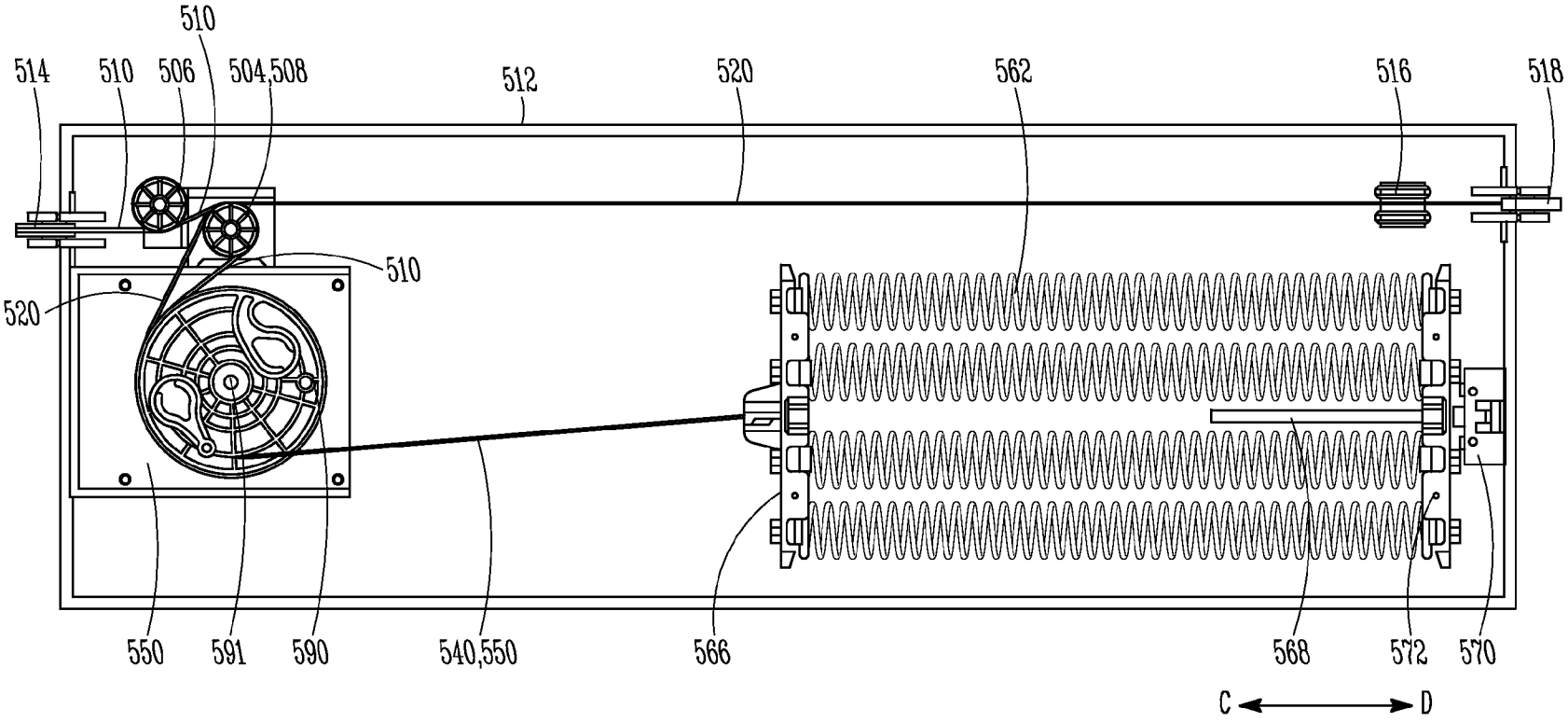
FIG. 21 is a top view of a counterbalance mechanism in accordance with at least one example of this disclosure.
Figure 22:
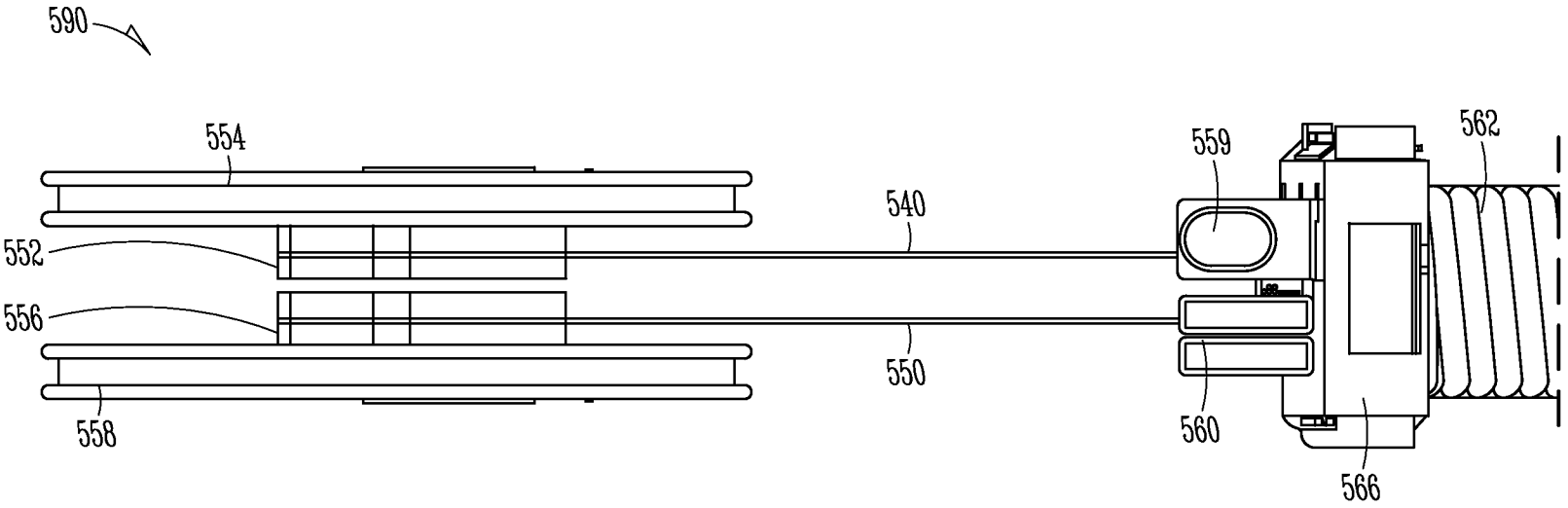
FIG. 22 is a front elevation view of a counterbalance mechanism in accordance with at least one example of this disclosure.

FIG. 21 shows a top view of an example of a counterbalance mechanism 500. All the components can be attached to a structural bracket 512, and the structural bracket 512 can be attached under the work surface 106. A number of springs 562 can be used in the system depending on the amount of the weight to be counterbalanced. One end of the springs 562 can be attached to the right spring holding bracket 572. The right spring holding bracket 572 can be threadingly attached to the adjustment screw 568 at its center. The adjustment screw 568 can be rotatingly connected to the spring adjustment assembly 570. The spring adjustment assembly 570 is similar to the design shown in FIG. 15. By turning the adjustment screw 568 via the spring adjustment assembly 570, the right spring holding bracket 572 can be moved to adjust the tension on the springs 562. The right spring holding bracket 572 can move along a direction indicated by the line "c-d" on FIG. 21. The left ends of the springs 562 are attached to the left spring holding bracket 566. The left spring holding bracket 566 has two sides. In the right side it can be attached to the extension springs 562. Two hooks, an upper hook 559 and a lower hook 560, are positioned on the left side of the left spring holding bracket, and the third and fourth tension members 540, 550 are attached to these hooks as illustrated in FIG. 22. As shown in FIGS. 21 and 22, the third tension member 540 and the fourth tension members 550 may be positioned in a plane, one above the other. As shown in FIG. 21, an axle 591 of the cam/wheel assembly 590 can be attached to the structural bracket 512 in a vertical direction. The cam/wheel assembly 590 can be allowed to rotate in a horizontal plane.

Figure 23A:
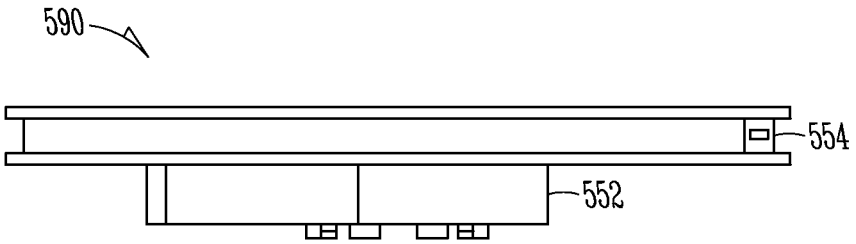
FIG. 23A-B are elevation views of a cam/wheel assembly of a counterbalance mechanism in accordance with at least one example of this disclosure.
Figure 23B:
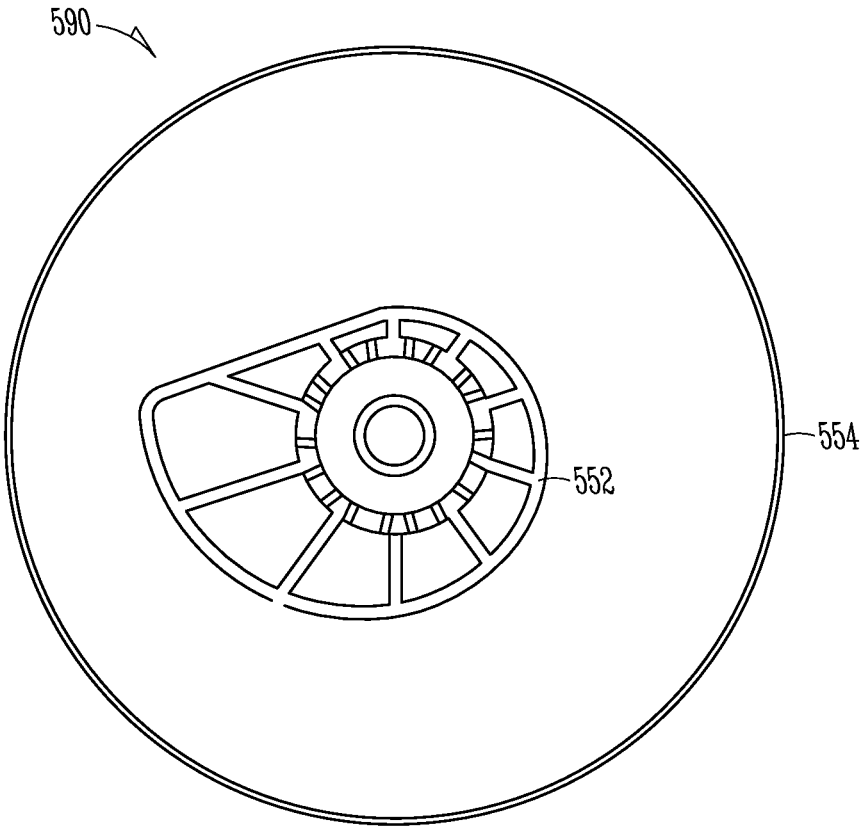

FIG. 23A-B are elevation and top views of a cam/wheel assembly 590 of a counterbalance mechanism 500 (see FIG. 18) in accordance with at least one example of this disclosure. The upper cam 552 and the upper wheel 554 can be molded together as shown in FIG. 23A-B. An upper cam 552 and upper wheel 554 assembly, and a lower cam 556 and lower wheel 558 assembly can be connected together as shown in FIG. 22. They can be fixed to each other, and they can rotate in unison. The third tension member 540 can be attached to the upper hook 559 on the left spring holding bracket 566, and stretched towards the cam/wheel assembly 590 and connected to the upper cam 552. The fourth tension member 550 can be attached to the lower hook 560 on the left spring holding bracket 566, and stretched towards the cam/wheel assembly and connected to the lower cam 556. During the height adjustment, cam/wheel assembly 590 can rotate in clockwise direction, third tension member 540 and fourth tension member 550 can be wrapped around upper and lower cams 552 and 556, respectively, while pulling the left end of the spring 562 towards the cam/wheel assembly 590. This increases the tension on third tension member and fourth tension member 540, 550, but this increase in the tension member tension can be balanced by reducing the cam radius at the tension member contact point.

Figure 24:
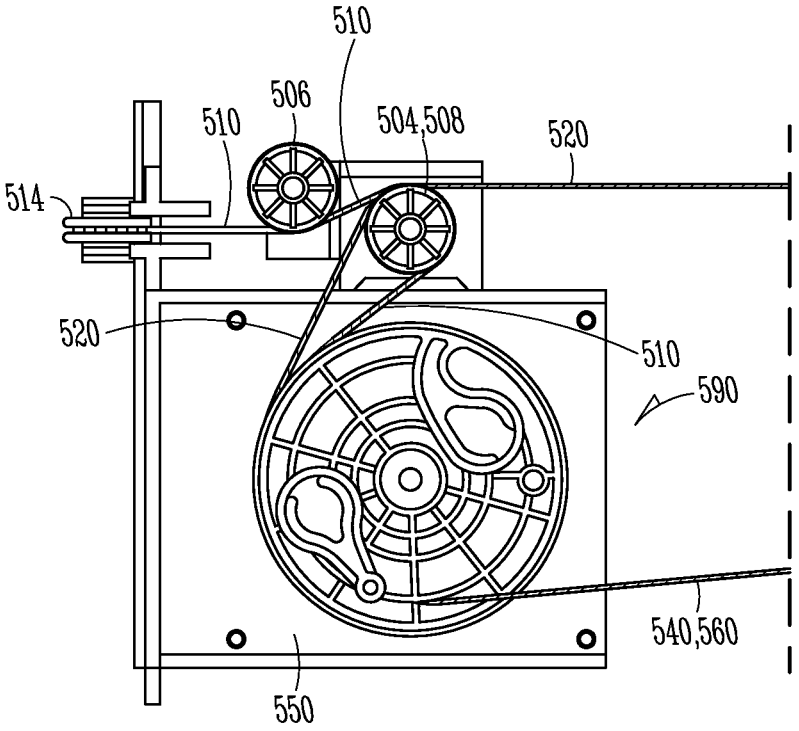
FIG. 24 is front elevation view of the cam/wheel assembly of a counterbalance mechanism in accordance with at least one example of this disclosure.
Figure 25:
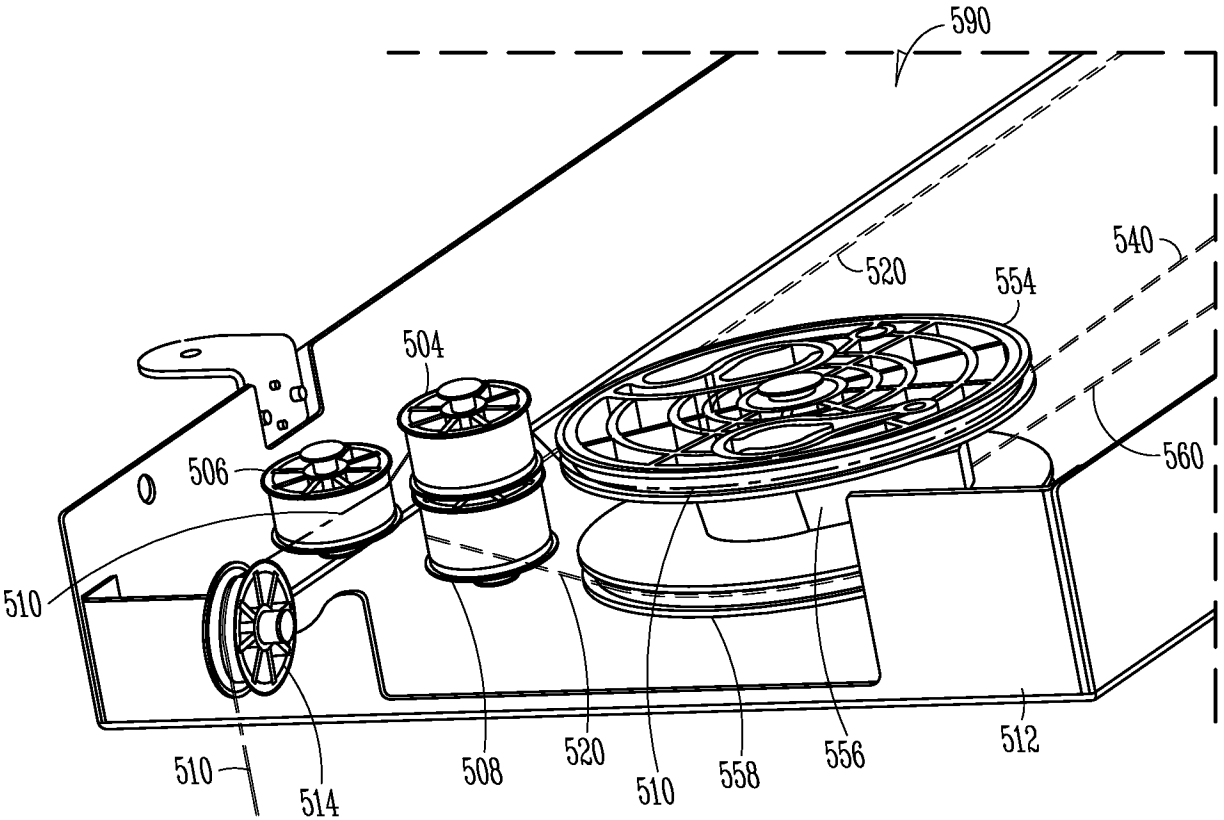
FIG. 25 is a perspective view of a cam/wheel assembly of a counterbalance mechanism in accordance with at least one example of this disclosure.

FIG. 24 is front elevation view of the cam/wheel assembly 590 of a counterbalance mechanism in accordance with at least one example of this disclosure. FIG. 25 is a perspective view of a cam/wheel assembly 590 of a counterbalance mechanism in accordance with at least one example of this disclosure. A close-up view of the cam/wheel assembly 590 and adjacent spools are shown in FIGS. 24 and 25. In this disclosure, a spool can function as a pulley and can provide a rotatable surface to aid in guiding a tension member. In the alternative, a stationary guide member can be used to provide a low friction direction changing or guiding device for a tension member. All the components shown in FIG. 25 can be attached to the structural bracket 512. A plurality of spools such as a first spool 506, a second spool 504, and a third spool 508, can be rotatingly coupled with the structural bracket 512 in the horizontal plane, and left pulley 514 can be rotatingly coupled with the structural bracket 512 in the vertical plane. Some of the attachment brackets are removed from the picture to make the spools 506, 508, 510 and left pulley 514 visible. Also, the upper cam 552 (see FIG. 22) is not visible in FIG. 25 under the upper wheel 554. Although second and third spools 504, 508 can be located on the same axis, they can be independently rotatable. One end of first tension member 510 can be attached to the upper wheel 554 and it can be routed around the second spool 504 and first spool 506 towards the left pulley 514. The left pulley 514 can be located over the first leg assembly 110 (see FIG. 26), and it can route the first tension member 510 downwards to attach to the leg assembly components. One end of second tension member 520 can be attached to lower wheel 558 and it can be routed around the third spool 508 towards right pulley 518 (see FIG. 21). The right pulley 518 can be located over the second leg assembly 120 (see FIG. 18), and it can route the second tension member 520 downwards to attach to the leg assembly components. A top view of tension member routing is shown in FIG. 24. FIGS. 24-25 show an example tension member routing according to one example of this disclosure. Other tension member routing configurations are also possible without changing the general intent of this disclosure.

Figure 26:
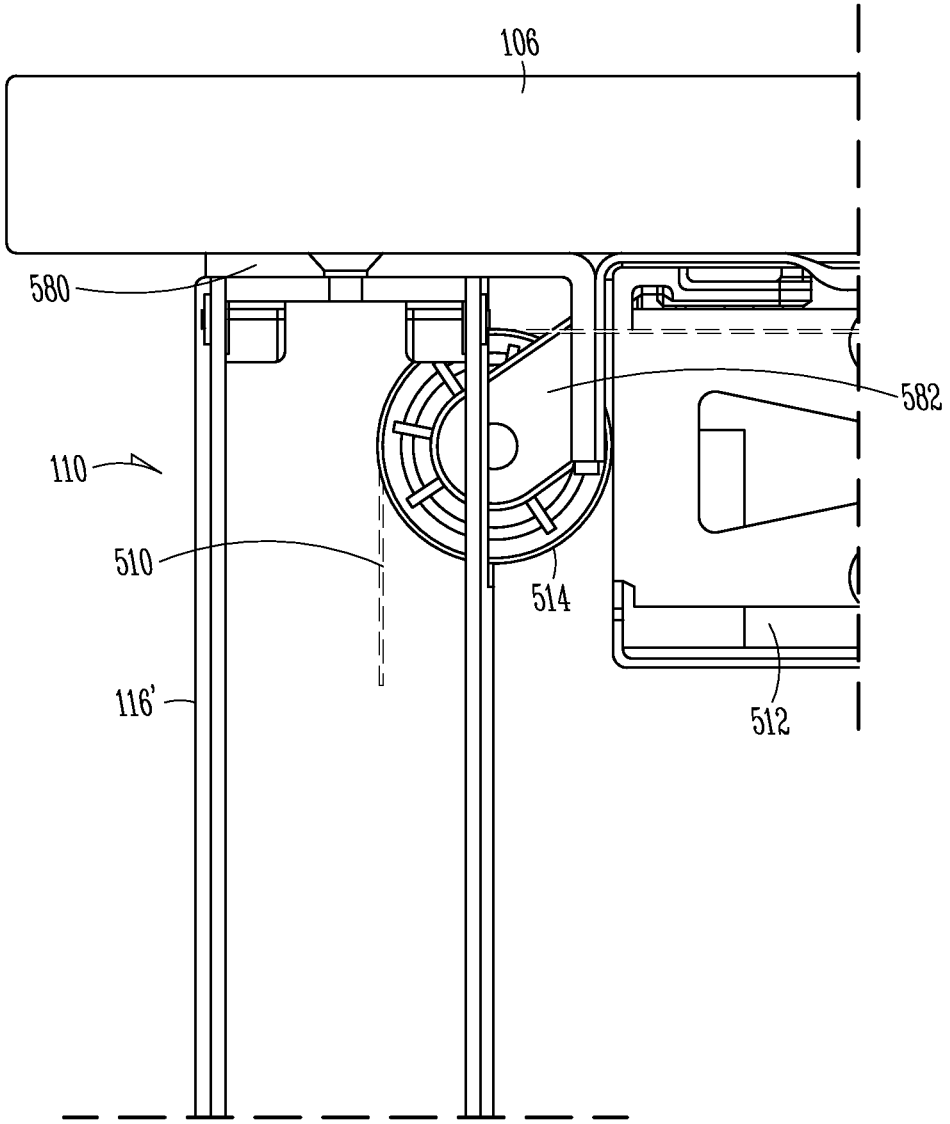
FIG. 26 is a front elevation view of a height adjustable desk with the cam/wheel assembly of a counterbalance mechanism in accordance with at least one example of this disclosure.

FIG. 26 illustrates how the first tension member 510 can be routed downwards over left pulley 514 to attach to the components of the first leg assembly 110 as explained in later figures. The top end of the upper tube 116' can be attached to a surface attachment bracket 580. The structural bracket 512 can be attached to the surface attachment bracket 580 as well. The work surface 106 can be attached to both the surface attachment bracket 580 and the structural bracket 512. The holding bracket 582 for the left pulley 514 can be attached to the surface attachment bracket 580. A similar arrangement can be used with respect to second leg assembly 120 (see FIG. 18).

Figure 27:
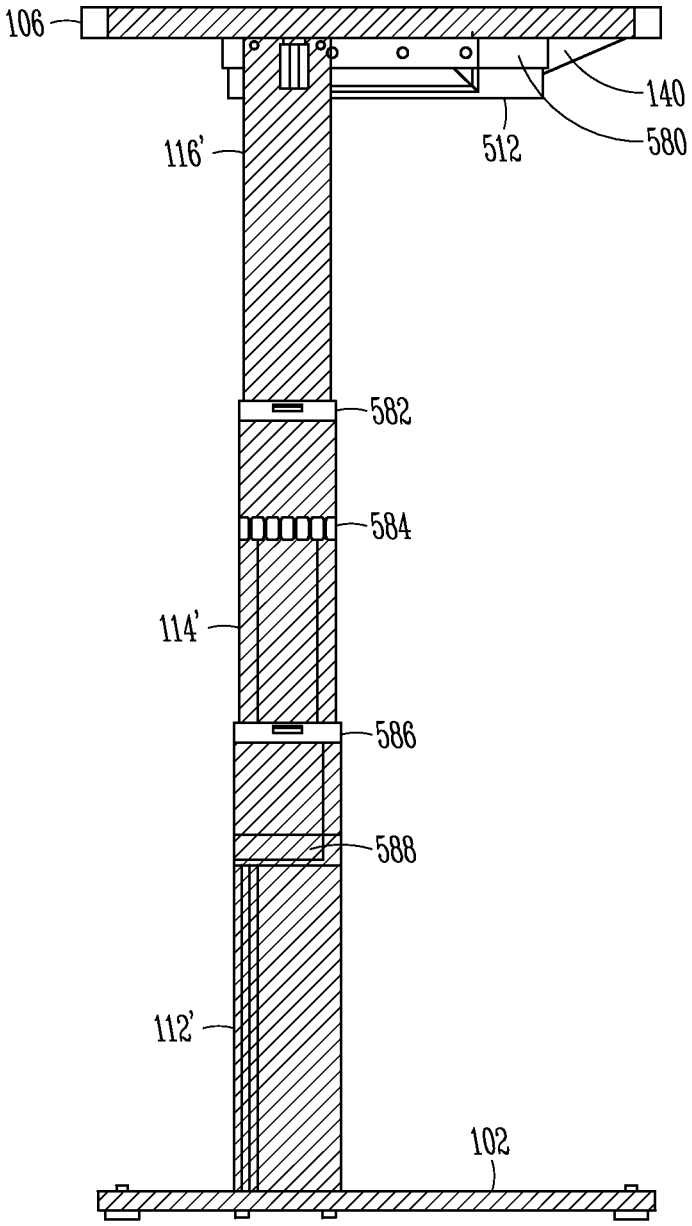
FIG. 27 is a side elevation view of a height adjustable desk in accordance with at least one example of this disclosure.

An example of a three member leg assembly is shown in FIG. 27. A plurality of guide members 582, 584, 586, 588 can be located between the telescoping tubes similar to the example shown in FIG. 10. An upper tube guide member 584 can be attached to the lower end of the upper tube 116'. A top middle tube guide member 582 can be located near the top of the middle tube 114'. A bottom middle tube guide member 588 can be located near the bottom of the middle tube 114'. A lower tube guide member 586 can be attached to the upper end of the lower tube 112'. The guides can be molded components. They provide smooth low friction surfaces between the tubes. In some configurations, vertical slides may be used. FIG. 27 illustrates a side view of the work surface 106, the surface attachment bracket 580, the structural bracket 512, the brake handle 140, and the first foot 102.

Figure 28:
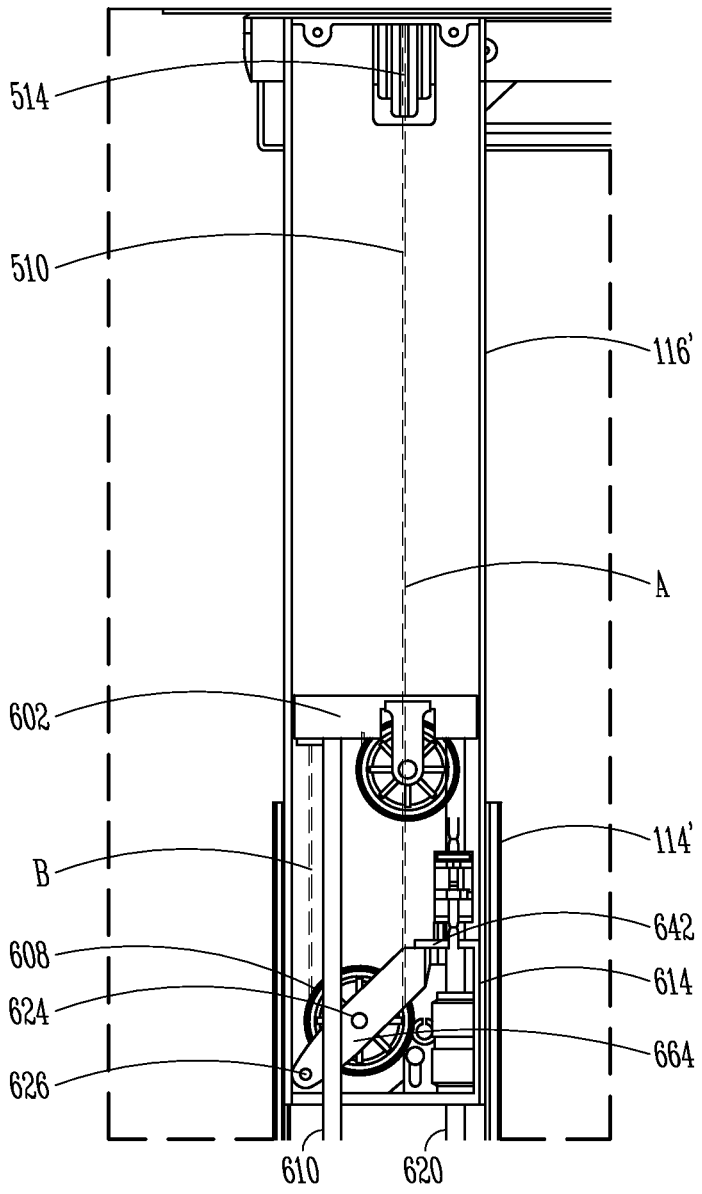
FIG. 28 is a side elevation view of a brake assembly in accordance with at least one example of this disclosure.

FIG. 28 illustrates an example of routing of the first tension member 510 inside the upper tube 116'. The first tension member 510 can be routed downwards over the left pulley 514. The first tension member 510 can be routed around an idler pulley 608, and the end of first tension member 510 can be attached to a top bracket 602. The idler pulley 608 can be rotatingly coupled with a brake bracket 664 at a first axle 624. The brake bracket 664 can be rotatingly coupled with the upper tube 116' at the second axle 626, and mounting bracket 614. When there is tension on the first tension member 510, the tension can rotate the brake bracket 664 in counter-clockwise direction until it stops against a stop surface 642. This can provide a control surface for the brake.

The top bracket 602 shown in FIG. 28 can be located inside the upper tube 116', and attached to the middle tube 114' via first and second rods 610, 620. The brake bracket 664 and the idler pulley 608 can be attached to the upper tube 116'. The first section "a" of the first tension member 510 can be between the left pulley 514 and the idler pulley 608, and the second section "b" of the first tension member 510 can be between the idler pulley 608 and the top bracket 602. During a downward height adjustment, the upper tube 116' moves down relative to the middle tube as explained in association with FIG. 4. The first section "a" of first tension member stays constant in length. The second section "b" of the first tension member increases in length as the work surface 106 moves down. Due to increased length of the second section "b" of the first tension member 510, more first tension member 510 can be pulled in to the upper tube 116' and the upper wheel 554 (see FIG. 25) can rotate to allow this change in length.

Figure 29:
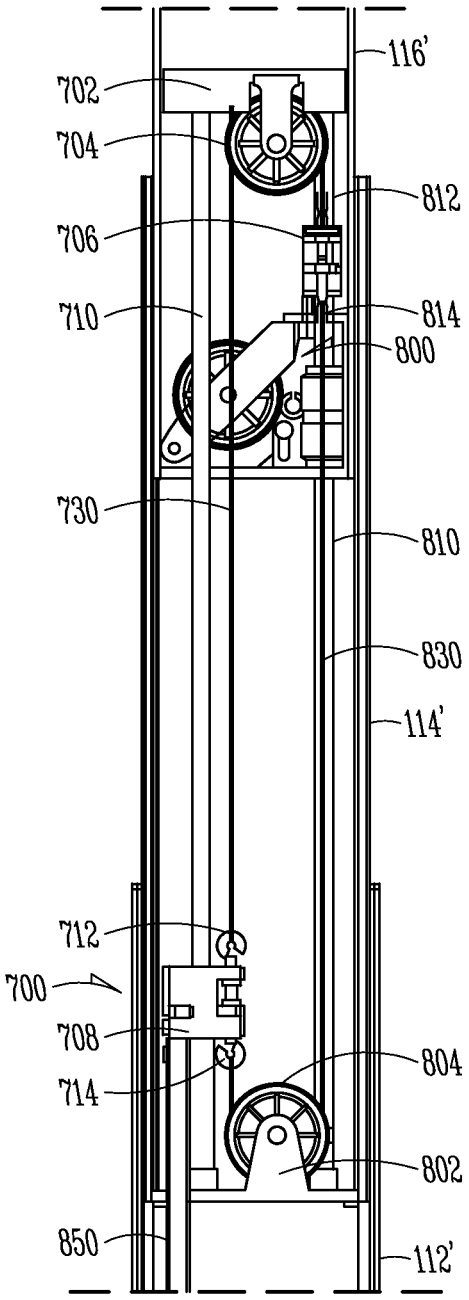
FIG. 29 is a front elevation view of a secondary brake assembly in accordance with at least one example of this disclosure.

FIG. 29 is a front elevation view of a lower secondary brake assembly 700 in accordance with at least one example of this disclosure. Movement of upper, middle and lower tubes 116', 114', 112' can be synchronized as explained in association with FIG. 4. When the tension members involved in this synchronization are broken, tubes can be locked, and the height adjustment mechanism can be disabled. This synchronization and a secondary brake for the height adjustable desk 100 shown in FIG. 18 are illustrated in FIG. 29. A bottom bracket 802 can be attached to the bottom end of the middle tube 114'. A top bracket 702 can be attached to the middle tube 114' via a first rod 710 and a second rod 810. The first rod 710 and the second rod 810 can be attached to the bottom bracket 802. The first and second rods 710, 810 can extend upwards to the inside of the upper tube 116'. The top bracket 702 can be attached to the top ends of the first and second rods 710, 810, and the top bracket 702 can be located inside the upper tube 116'. A first pulley 704 can be attached to the top bracket 702, and the second pulley 804 can be attached to the bottom bracket 802. The first pulley 704 and second pulley 804 can be rotatingly coupled to the top and bottom brackets 702, 802, respectively.

Figure 30:
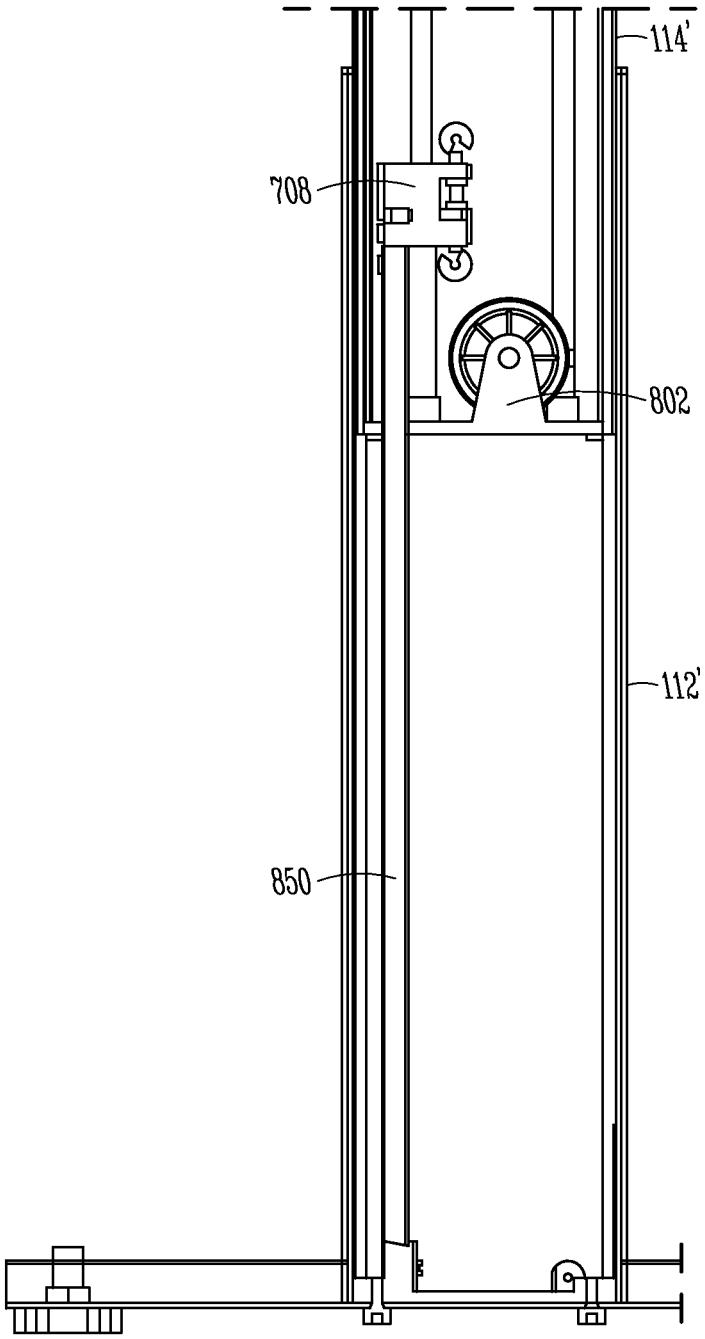
FIG. 30 is a side elevation view of a secondary brake assembly in accordance with at least one example of this disclosure.

A first brake bracket 706 can be attached to upper tube 116', and second brake bracket 708 can be attached on top of the third rod 850. The bottom of the third rod 850 can be attached to the lower tube 112' as shown in FIG. 30, and the third rod 850 can extend upwards inside the middle tube 114'. Returning to FIG. 29, the first and second hooks 712, 714 can be attached to the lower secondary brake assembly 700, and the third and fourth hooks 812, 814 can be attached to and upper secondary brake mechanism 800. A first end of a fifth tension member 730 can be attached to the first hook 712, and the fifth tension member 730 can be stretched upwards and routed around the first pulley 704, and the second end of fifth tension member 730 can be attached to the third hook 812. A first end of the sixth tension member 830 can be attached to the second hook 714, and the sixth tension member 830 can be stretched downwards and routed around the second pulley 804, and the second end of the sixth tension member 830 can be attached to the fourth hook 814. During the height adjustment, the fifth and sixth tension members 730, 830 slide over the first and second pulleys 704, 804, respectively, but their overall lengths do not change, therefore, the motion of the middle tube 114' and the upper tube 116' can be synchronized. If the middle tube moves a distance "X" relative to the lower tube 112', the upper tube 116' can also move a distance "X" relative to the middle tube 114' in this example.

Figure 31:
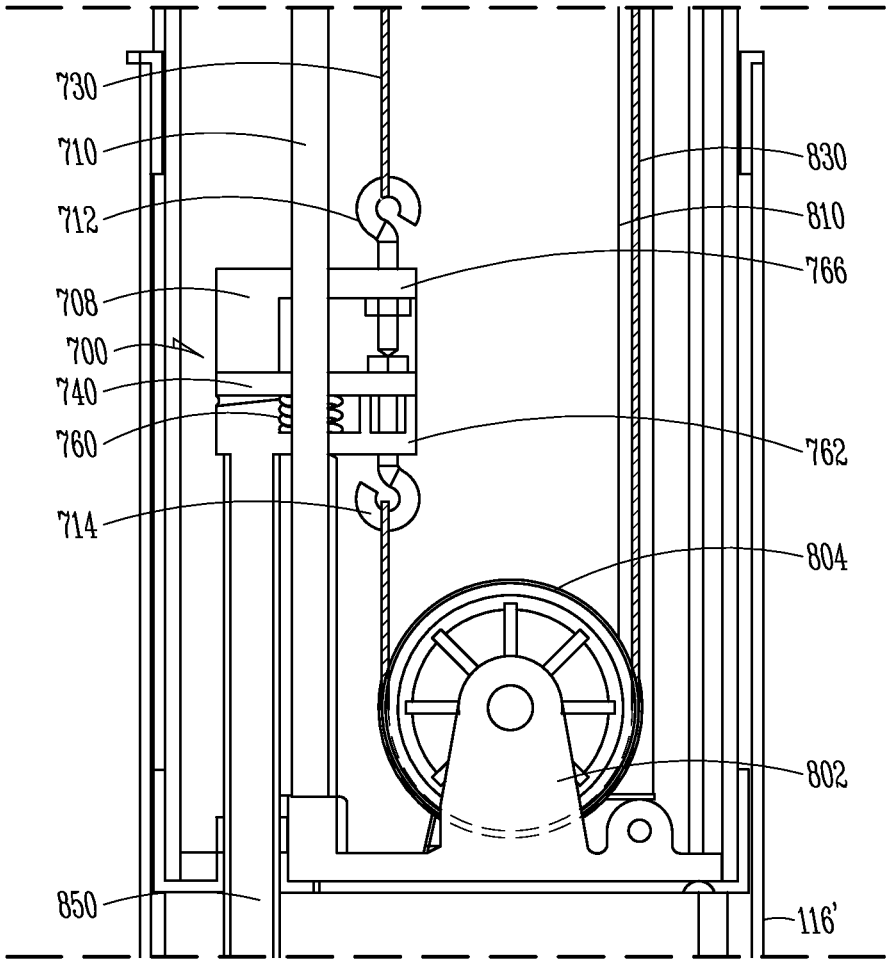
FIG. 31 is a front elevation view of a secondary brake assembly in accordance with at least one example of this disclosure.

FIG. 31 is a front elevation view of a lower secondary brake assembly 700 in accordance with at least one example of this disclosure. The second brake bracket 708 can be attached on top of the third rod 850. The first hook 712 can be attached to the upper tab 766. The second hook 714 can be attached to the flat bracket 740. The fifth tension member 730 can be attached to the first hook 712 and the sixth tension member 830 can be attached to the second hook 714. A compression spring 760 can be coaxial with first rod 710, and it can be located between the flat bracket 740 and lower tab 762. The first rod 710 and the second rod 810 can be attached to the bottom bracket 802. During the normal operation of the lift mechanism, there can be tension in the fifth and sixth tension members 730, 830. Therefore, flat brackets are pulled downwards against the lower tab 762. In this configuration, the compression spring 760 can be compressed between the flat bracket 740 and the lower tab 762. If tension is inadvertently lost on the sixth tension member 830, the flat bracket 740 will be angled relative to the first rod 710 due to the force of the compression spring 760, and the flat bracket 740 will grab on to the first rod 710.

Figure 32:
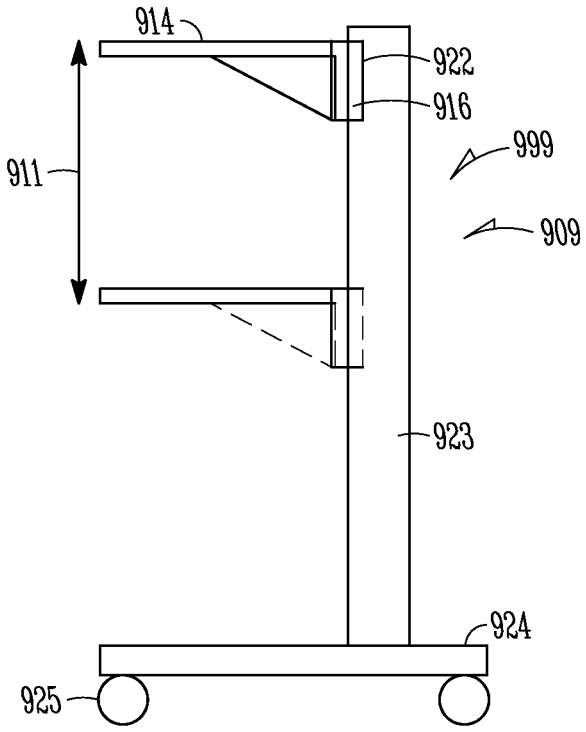
FIG. 32 illustrates a side view of a height adjustable desk with a fixed height leg assembly and a moving bracket in accordance with at least one example of this disclosure.

FIG. 32 illustrates a side view of a height adjustable desk 910 with a fixed height leg assembly and a moving bracket in accordance with at least one example of this disclosure. In an example, leg assembly 909 can be at a fixed height, and a moveable bracket 922 can be slidably engaged with the leg assembly 909 and can provide the height adjustment 911 as illustrated in FIG. 32. The leg assembly 909 can be used as a lift mechanism 999 that can be used to provide support and counteract a downward force for numerous applications including a work surface, table, or desk 910. A fixed height first member 923 can be attached to the top of a base 924. The base 924 can include casters 925 that can provide mobility to the unit. A second member 916, such as the moveable bracket 922, can be slidably engaged with the fixed height first member 923. A work surface 914 can be attached to the moveable bracket 922. The moveable bracket 922 can be supported by a counterbalance mechanism 926 (see FIG. 33) located inside the fixed height first member 923. The counterbalance mechanism 926 can be any one of a gas spring, a pulley system attached to an energy storage member, an electric motor, a linear actuator, a hydraulic actuator, or other similar devices or methods.

Figures 33A, 33B:
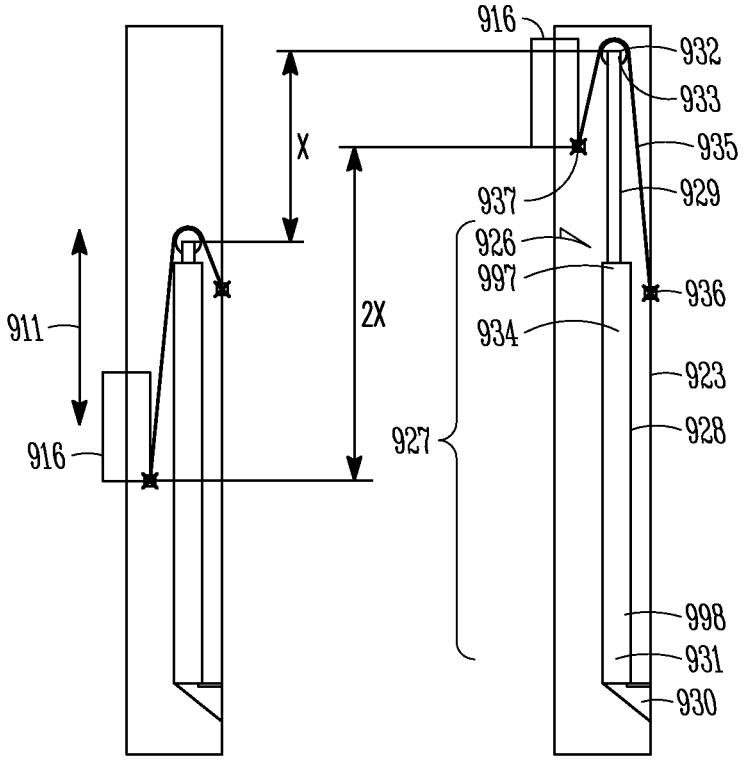
FIGS. 33A-33B illustrate a side view of a counterbalance mechanism in accordance with at least one example of this disclosure.

FIGS. 33A-33B illustrate a side view of a counterbalance mechanism 926 using a gas spring 927 in accordance with at least one example of this disclosure. The gas spring 927 can include a cylinder 928 and a piston 929 and the piston 929 can move in and out of the cylinder 928. The cylinder 928 can include a closed end 998 that can be attached to a leg assembly 99, 909, 938 (see FIGS. 1, 32, 34, 38, 41). Opposite the closed end 998, the cylinder 928 can include a piston end 997 from which a piston 928 can extend and retract. The gas spring 927 can be attached to the fixed height first member 923 via a support bracket 930. The support bracket 930 can be fixedly attached to the fixed height first member 923, and it can be located anywhere along the length of the fixed height first member 923. A cylinder base 931 can be attached to the support bracket 930. The piston 929 can be freely allowed to move in and out of the gas spring 927 during a height adjustment 911. A pulley 932 can be rotatingly coupled with the piston 929 on a piston outer end 933. An interface bracket (not shown in FIG. 33) may be used to provide coupling between the pulley 932 and the piston 929. An additional support bracket (not shown in the FIG. 33) can also be attached between fixed height first member 923 and the cylinder 928 close to the cylinder upper end 934 to make sure that the gas spring 927 maintains its orientation relative to the fixed height first member 923 during the height adjustment 911. A tension member 935 can be attached between fixed height first member 923 and a second member 916 which can be moveable. The tension member 935 can be any linear connecting member such as a rope, a chain, a wire, a cable or belt. A tension member first end 936 can be fixedly attached to the fixed height first member 923. The tension member 935 can be routed around the pulley 932, and a tension member second end 937 can be attached to the second member 916. In an example configuration such as illustrated in FIG. 33A-B, when the piston 929 of the gas spring 927 moves a distance of X distance, the second member 916 can travel a distance of 2X distance.

Figure 34:
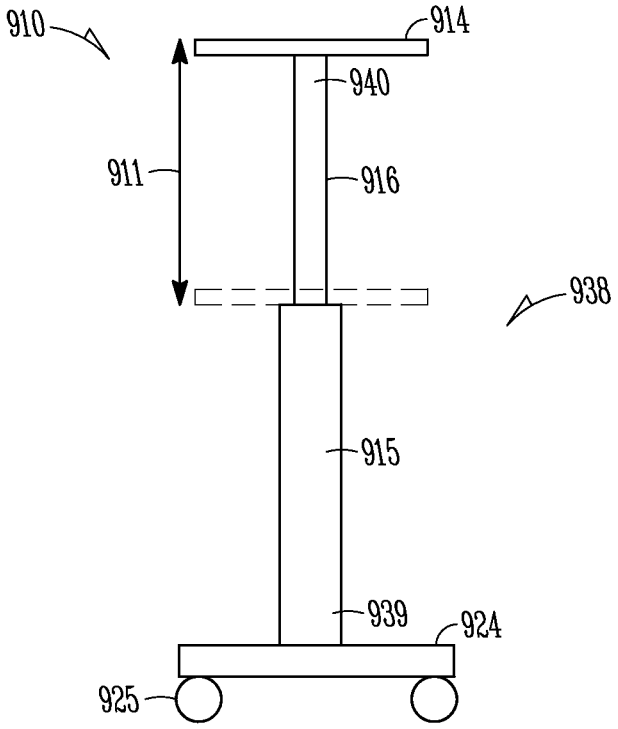
FIG. 34 illustrates a side view of a height adjustable work surface with a two member leg assembly in accordance with at least one example of this disclosure.

FIG. 34 illustrates a side view of a height adjustable desk 910 with a two member leg assembly 938 in accordance with at least one example of this disclosure. The leg assembly 938 can include a first member 915 and a second member 916 and the second member 916 can be slidably engaged with first member 915. The first member 915 can be fixedly attached to a base 924 at a first member bottom end 939. The second member 916 can move in and out of the first member 915 during a height adjustment 911 thereby changing the total height of the leg assembly 938. A work surface 914 can be attached to a second member upper end 940. The height of the work surface 914 can be adjusted as the height of the leg assembly 938 is varied. A counterbalance mechanism 926 (See FIG. 33) can be contained inside the leg assembly 938 and can provide lift assist during the height adjustment 911. The counterbalance mechanism 926 can carry at least part of the combined weight of the second member 916; work surface 914, and any components that may be located on the work surface 914. The base 924 can include casters 925 to provide a moveable unit. If a synchronization assembly 165 such as described in FIG. 4 is removed from any of the previously described three member leg assemblies, the counterbalance mechanism for any of the three-member leg assemblies described in previous sections can be used in a two-member leg assembly. One of the first or second members can contain the counterbalance mechanism, and the other member can be immediately adjacent to the member containing the counterbalance mechanism. The other member can be connected to the counterbalance mechanism through a tension member.

Figures 35A, 35B:
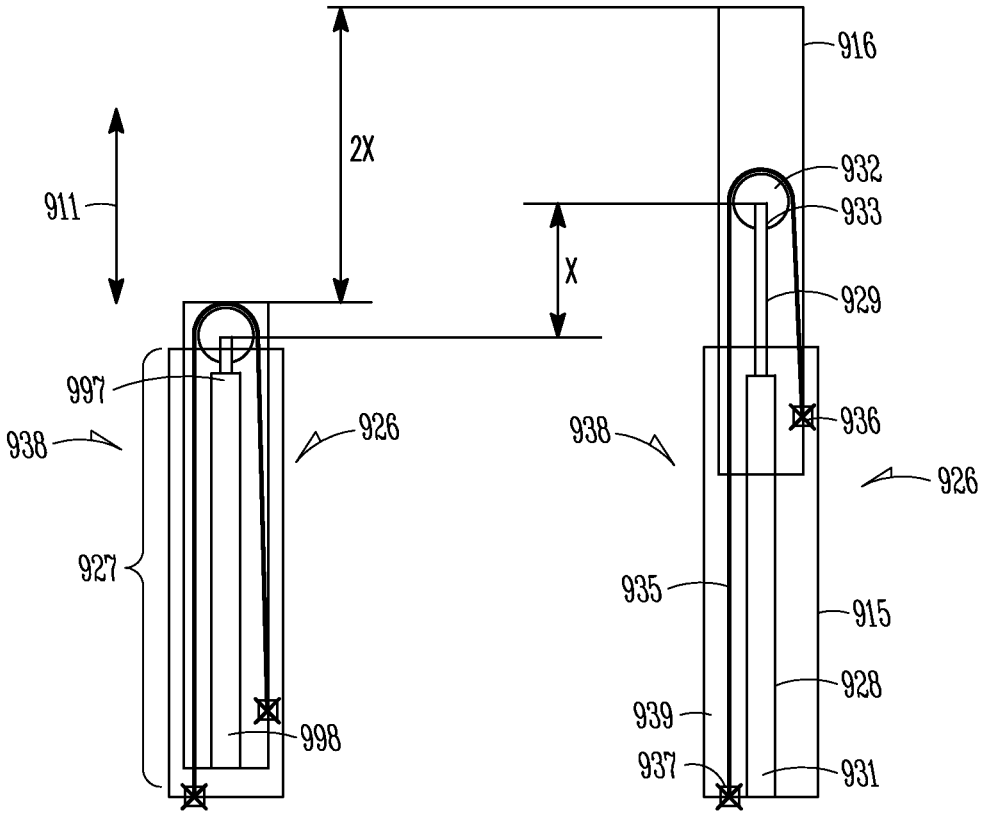
FIGS. 35A-35B illustrate a side view of a counterbalance mechanism using a gas spring in accordance with at least one example of this disclosure.

FIGS. 35A-35B illustrate a side view of a leg assembly 938 having a counterbalance mechanism 926 using a gas spring 927 in accordance with at least one example of this disclosure. The leg assembly 938 can include a telescoping configuration of a first member 915 and a second member 916. A cylinder base 931 or closed end 998 can be fixedly attached to a first member bottom end 939. A piston 929 can be allowed to move in/out of the piston end 997 of the cylinder 928 during a height adjustment 911. A pulley 932 can be rotatingly coupled with the piston 929 on a piston outer end 933. An interface bracket (not shown in the FIGS. 35A-B) may be used to provide coupling between the pulley 932 and the piston 929. A tension member 935 can be attached between the first member 915 and the second member 916. A tension member first end 936 can be fixedly attached to the second member 916. The tension member 935 can be routed around the pulley 932, and a tension member second end 937 can be fixedly attached to the first member 915. Attachment locations for the tension member 935 to the first member 915 and second member 916 can vary depending on the application. With the configuration illustrated in FIGS. 35A-B, when the piston 929 of the gas spring 927 can move X distance, the second member 916 of the leg assembly 938, and thus, the work surface 914 (see FIG. 34) can move 2X distance. The gas spring 927 can be locked and the piston 929 will not move in or out of the cylinder 928. Since the pulley 932 can be fixedly attached to the piston 929, it will not be possible to lower the second member 916 when the gas spring 927 is locked. Locking the gas spring 927 in this configuration can still allow upward movement of the second member 916. The gas spring 927 can be unlocked, and the piston 929 can move out of the cylinder 928, and thus, push the second member 916 upwardly.

Figure 36:
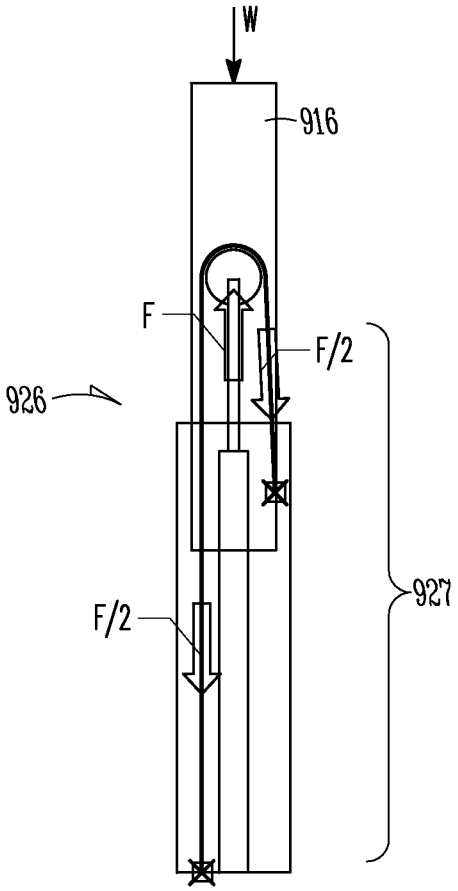
FIG. 36 illustrates a force distribution diagram for a gas spring counterbalance mechanism in accordance with at least one example of this disclosure.

FIG. 36 illustrates a force distribution diagram for a gas spring 927 counterbalance mechanism 926 in accordance with at least one example of this disclosure. A counterbalance mechanism 926 can carry at least part of a combined weight W of the second member 916, work surface 914 (see FIGS. 32, 34, 38, and components located on the work surface 914. With a pulley and tension member assembly, half of the total lift force (or F/2) provided by the gas spring 927 is transferred to the second member 916. Therefore, gas spring lift force F must be properly set such that half of the gas spring force (or F/2) is approximately equal to the combined weight W of the second member 916, work surface 914, and any components that are located on the work surface. If the counterbalance mechanism 926 provides less force than W to counteract weight W, the desk user can provide additional force to move the work surface 914 upwards. Counterbalance mechanisms can be selected or adjusted to fit a particular desk or work surface 914 and to fit particular loads the work surface 914 might support.

Figure 37A:
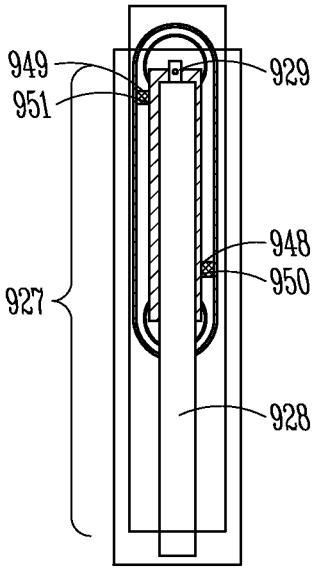
FIGS. 37A-37B illustrate a side view of a counterbalance mechanism using a gas spring in accordance with at least one example of this disclosure.
Figure 37B:
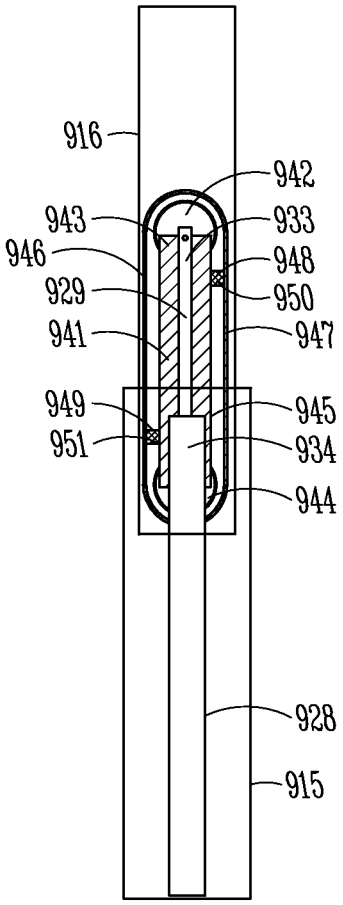

FIGS. 37A-37B illustrate a side view of a counterbalance mechanism 926 using a gas spring 927 in accordance with at least one example of this disclosure. A pulley bracket 941 can be attached to the piston outer end 933, and the pulley bracket 941 can move with the piston 929 during a height adjustment 911 (see FIG. 34). At least part of the pulley bracket 941 can overlap with the cylinder 928. A first pulley 942 can be attached to a pulley bracket upper end 943, and a second pulley 944 can be attached to a pulley bracket lower end 945. A first tension member 946 and a second tension member 947 can engage the first pulley 942 and the second pulley 944. A first tension member first end 948 can be fixedly attached to the second member 916. The first tension member 946 can be routed up and around the first pulley 942, and a first tension member second end 949 can be fixedly attached to the cylinder upper end 934. Since the cylinder 928 can be fixedly attached to the first member 915, attaching the first tension member 946 to the cylinder 928 is similar to attaching the first tension member 946 to the first member 915. In other examples, various other means such as a separate rod, or bracket may be employed to attach the first tension member second end 949 to the first member 915. A second tension member first end 950 can be fixedly attached to second member 916. The second tension member 947 can be routed down and around the second pulley 944, and a second tension member second end 951 can be fixedly attached to the cylinder 928. The counterbalance mechanism 926 illustrated in FIGS. 37A-B can operate in a similar manner as the counterbalance mechanism 926 illustrated in FIGS. 35A-B. In the configuration illustrated in FIGS. 37A-B, the cylinder 928 can be locked and a work surface 914 (see FIG. 34) cannot be moved upwardly or downwardly.

Figure 38:
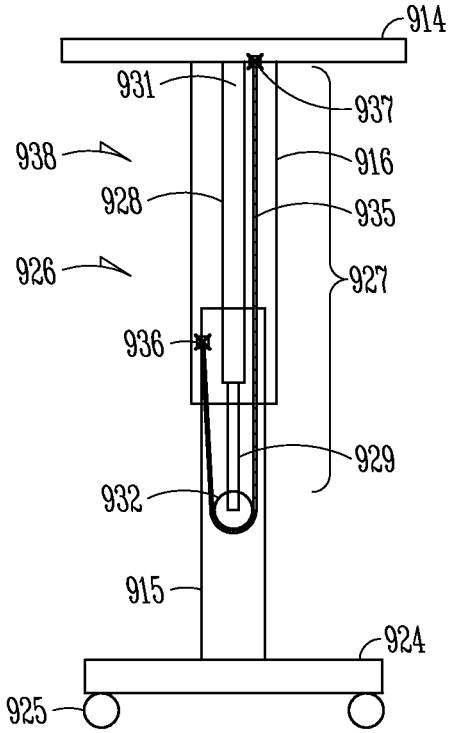
FIG. 38 illustrates a side view of a height adjustable work surface with a two member leg assembly and a gas spring attached to a second member in accordance with at least one example of this disclosure.

FIG. 38 illustrates a side view of a height adjustable desk 100 with a two member leg assembly 938 and a gas spring 927 attached to a second member 916 in accordance with at least one example of this disclosure. In the counterbalance mechanisms illustrated in FIGS. 34-37, the cylinder 928 can be fixedly attached to the first member 915. In alternative examples, the cylinder 928 of FIGS. 34-37 can be attached to the second member 916 as illustrated in FIG. 38 without changing the general intent of this disclosure. The counterbalance mechanism 926 can still function in a similar manner. As illustrated in FIG. 38, a leg assembly 938 can include a first member 915 and a second member 916 attached to a base 924. The base 924 can include casters 925. The cylinder base 931 can be attached to a work surface 914 or the upper end of the second member 916. The piston 929 can move outwardly from the bottom of the second member 916 and include a pulley 932 and a tension member 935. The tension member 935 can be attached to the first member 915 at a tension member first end 936 and attached to the second member 916 at a tension member second end 937.

Figure 39:
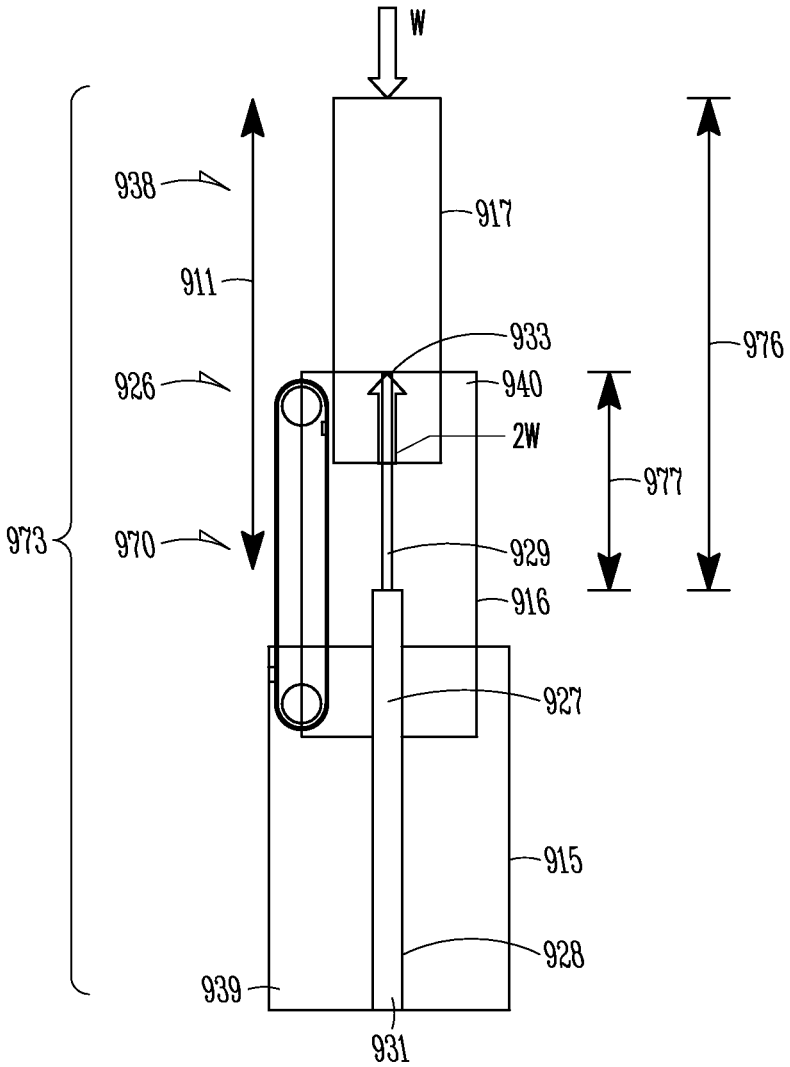
FIG. 39 illustrates a side view of a counterbalance mechanism using a gas spring in a three member leg assembly in accordance with at least one example of this disclosure.

FIG. 39 illustrates a side view of a counterbalance mechanism 926 using a gas spring 927 in a three member leg assembly 938 in accordance with at least one example of this disclosure. Movement of the telescoping members 973 of the leg assembly 938 can be synchronized by an idler pulley assembly 970 as explained in association with FIG. 4. All of the previously described two member leg assemblies can add a moveable third member 917, by adding a synchronization assembly 165, such as the idler pulley assembly 970 as explained in association with FIG. 4. A gas spring 927 can be attached between the first member 915 and the second member 916. A cylinder base 931 can be fixedly attached to the first member bottom end 939. The piston outer end 933 can be attached to a second member upper end 940. The second member 916 can move with the piston 929 during a height adjustment 911. In this configuration, a total travel 976 of the third member 917 can be twice as long as a stroke 977 of the piston 929 and a gas spring force 2W can be two times the desired weight W that can be counterbalanced.

Figure 40:
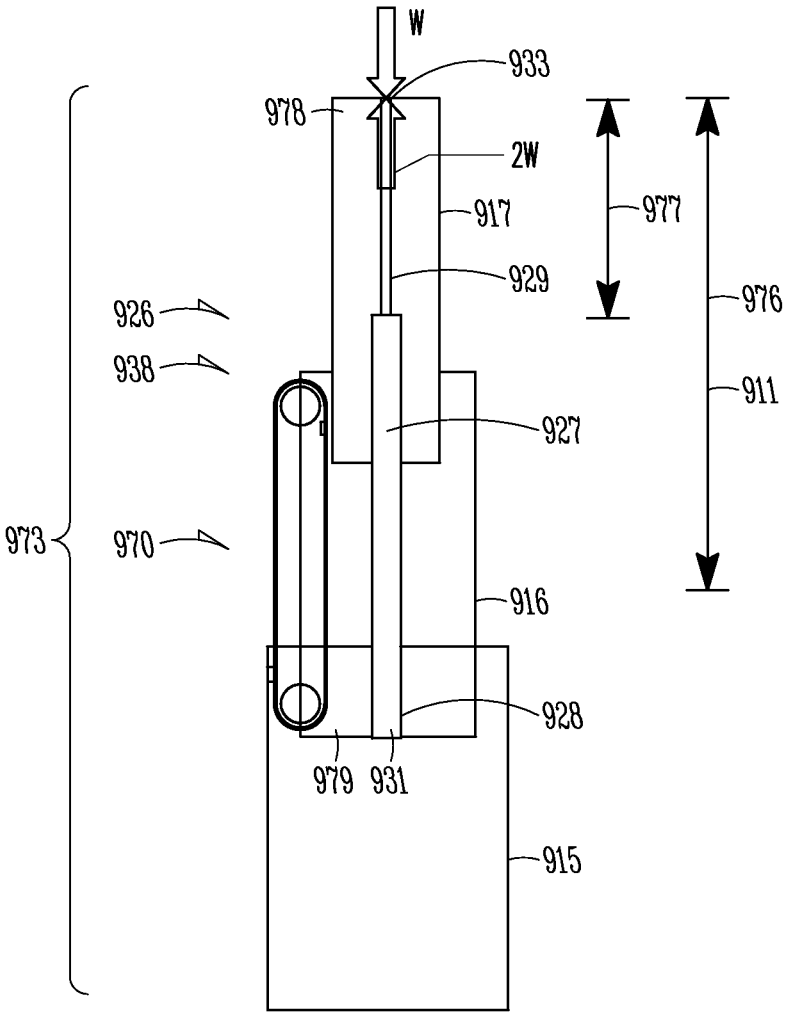
FIG. 40 illustrates a side view of a counterbalance mechanism using a gas spring in a three member leg assembly in accordance with at least one example of this disclosure.

FIG. 40 illustrates a side view of a counterbalance mechanism 926 using a gas spring 927 in a three member leg assembly 938 in accordance with at least one example of this disclosure. Movement of the telescoping members 973 of the leg assembly 938 can be synchronized by the idler pulley assembly 970 as explained in association with FIG. 4. A gas spring 927 can be attached between a second member 916 and a third member 917. The cylinder base 931 can be fixedly attached to the second member bottom end 979. The piston outer end 933 can be attached to a third member upper end 978. A displacement or travel of the third member 917 relative to the second member 916 can be the same displacement as the stroke 977 of the piston 929 during the height adjustment 911. In this configuration, total travel 976 of the third member 917 can be twice as long as the stroke 97 and gas spring force 2W can be two times the desired weight W that can be counterbalanced.

Figure 41:
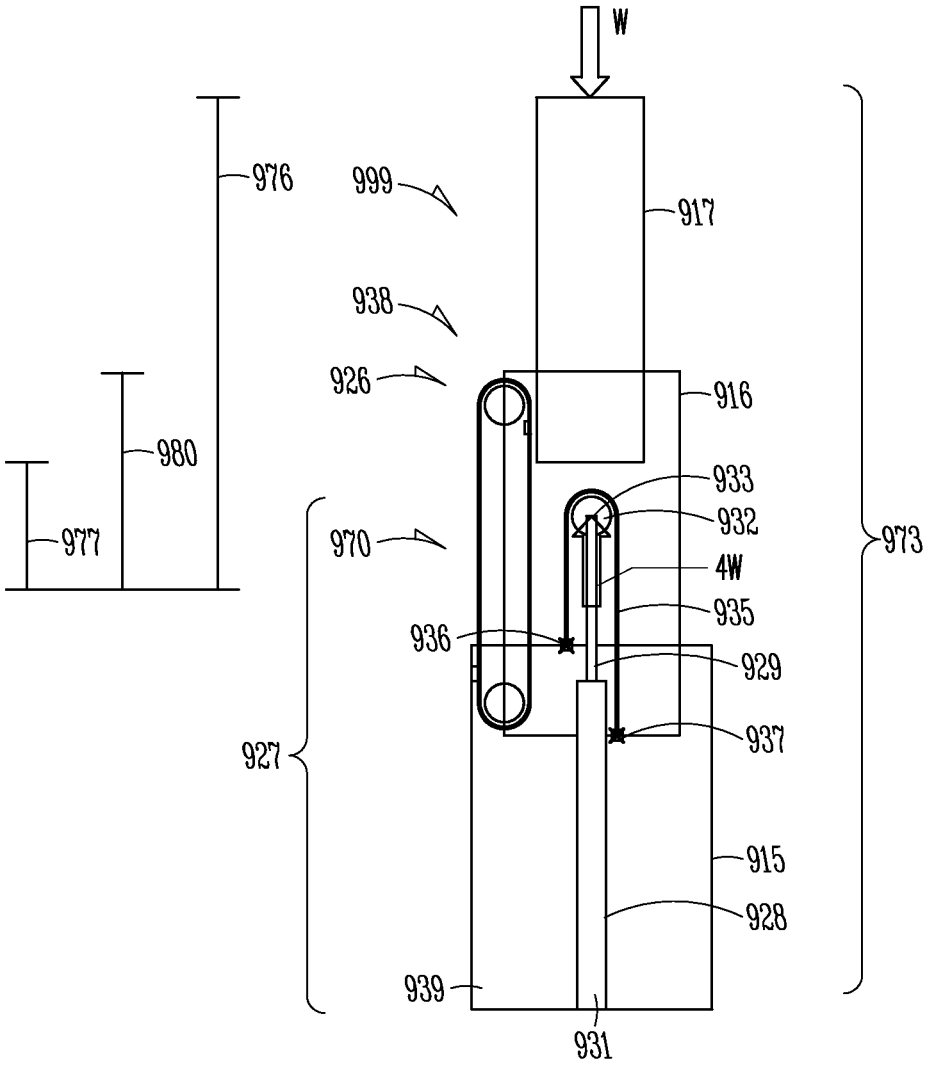
FIG. 41 illustrates a side view of a counterbalance mechanism using a gas spring in a three member leg assembly in accordance with at least one example of this disclosure.

FIG. 41 illustrates a side view of a counterbalance mechanism 926 using a gas spring 927 in a three member leg assembly 938 in accordance with at least one example of this disclosure. The leg assembly 938 can also function as a lift mechanism 999. Movement of the telescoping members 973 of the leg assembly 938 can be synchronized by the idler pulley assembly 970 as explained in association with FIG. 4. The synchronization assembly 165 (see FIG. 4), can also be called an idler pulley assembly 970 and can partially transfer one of: a) movement between the first member 915 and the second member 916 to movement between the second member 916 and the third member 917, or b) movement between the second member 916 and the third member 917 to movement between the first member 915 and the second member 916. The idler pulley assembly 970 can balance movement between the first and second members 915, 916 with movement between the second and third members 916, 917.

In the configuration illustrated in FIG. 41, the cylinder base 931 can be fixedly attached to the first member bottom end 939. The piston 929 can be free to move in/out of the cylinder 928. A pulley 932 can be rotatingly coupled to the piston outer end 933. A tension member 935 can be attached between the first member 915 and the second member 916. The tension member first end 936 can be fixedly attached to the first member 915. The tension member 935 can be routed up and around the pulley 932 and the tension member second end 937 can be fixedly attached to the second member 916. In this configuration, the second member 916 can include a displacement 980 that is twice the distance of the stroke 977 of the piston 929. The total travel 976 of the third member 917 can be four times the stroke 977 of the piston 929, and gas spring force 4W can be four times the desired weight W that can be counterbalanced.

Although FIG. 41 is illustrated having the cylinder 928 attached to the first member bottom end 939, configurations such as illustrated in FIGS. 6A, 6B, 7A, 7B, 8A and 8B are also fully contemplated by this disclosure. The cylinder base 931 can be attached to the top or bottom of the third member as in FIGS. 6A-B. The cylinder base 931 can be attached to the top or bottom of the first member that slides internally to a second member, that slides internally to a third member as in FIGS. 7A-B. The cylinder base 931 can be attached to the top or bottom of the second member as in FIGS. 8A-B. In each of the previous three member examples, the tension member can engage the pulley wheel attached to the piston and each end of the tension member can be attached to adjacent members. For example in a configuration similar to that illustrated in FIG. 6A, the tension member can be attached to the second member and the third member. In each of the previous three member examples, the synchronization assembly can include a first pulley near the top of the second member and a second pulley near the bottom of the second member. Each synchronization pulley can engage a tension member that can be attached to non-adjacent leg members, such as to the first member and the third member.

Figure 42:
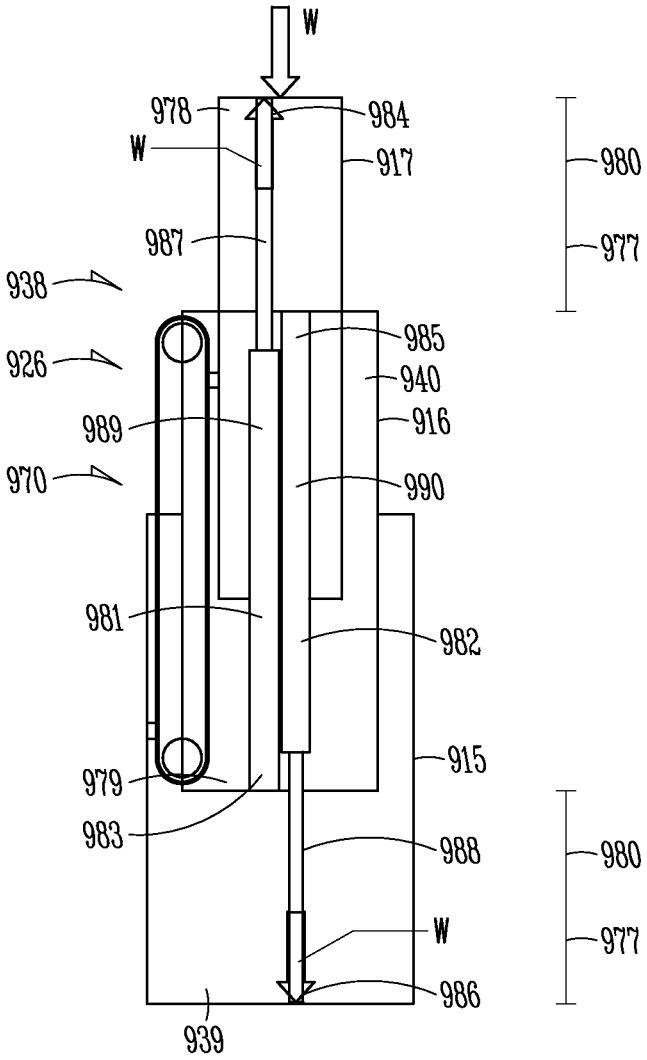
FIG. 42 illustrates a side view of a counterbalance mechanism using a gas spring in a three member leg assembly in accordance with at least one example of this disclosure.

FIG. 42 illustrates a three member leg assembly 938 in another example that can include two gas springs. A counterbalance mechanism 926 can include a first gas spring 981 and second gas spring 982. The first gas spring 981 can include a first piston 987 and a first cylinder 989. The second gas spring 982 can include a second piston 988 and a second cylinder 990. In this configuration, first and second gas springs 981, 982 can be attached to the second member 916. A first cylinder base 983 can be fixedly attached to the second member bottom end 979. A first piston outer end 984 can be fixedly attached to the third member upper end 978. The displacement 980 of the third member 917 relative to the second member 916 can be the same as the stroke 977 of the first gas spring 981. The second gas spring 982 can be oriented upside down relative to the first gas spring 981. The second cylinder base 985 can be fixedly attached to the second member upper end 940. The second piston outer end 986 can be fixedly attached to the first member bottom end 939. The displacement 980 of the second member 916 relative to the first member 915 can be the same as the stroke 977 of the second gas spring 982. Each gas spring force can be equivalent to the desired weight W that can be counterbalanced. An idler pulley assembly 970 is not needed to build this lift mechanism. The counterbalance mechanism 926 will function without the idler pulley assembly 970. However, to synchronize the telescoping motion between the first member 915 and the second member 916 with the telescoping motion between the second member 916 and the third member 917, an idler pulley assembly 970 can be used.

Various examples of the height adjustment mechanisms are described in previous sections in association with FIGS. 32-42 for a work surface 914 supported by a single leg assembly 909. However, multiple leg assemblies 99, 909, 938 can be used for a height adjustment 911 as described earlier in this disclosure and whether illustrated as a single leg assembly or a multiple leg assembly either can be used without changing the general intent of this disclosure. The leg assemblies 99, 909, 938 can be used as a lift mechanism 999 that can be used to provide support and counteract a downward force for numerous applications including a work surface 914, a table, or desk 100.

Thus, examples of this disclosure are disclosed. Although the present invention has been described in considerable detail with reference to certain disclosed examples, the disclosed examples are presented for purposes of illustration and not limitation and other examples of this disclosure are possible. One skilled in the art will appreciate that various changes, adaptations, and modifications may be made without departing from the spirit of this disclosure.

What is claimed is:

1. A lift mechanism comprising:

a first member; and a second member moveable relative to the first member along a longitudinal axis; and a counterbalance mechanism configured to counteract a force exerted on the lift mechanism, the counterbalance mechanism including:

a first gas spring having a moveable piston slidably attached to a first cylinder, the first cylinder attached to the lift mechanism;

a second gas spring having a moveable piston slidably attached to a second cylinder, the second cylinder attached to the lift mechanism, the second gas spring extending in an opposite direction from the first gas spring; and at least one wheel rotatably connected to the second member; and a tension member engaged to the wheel, the tension member having a first end and a second end, the first end attached to the lift mechanism.

2. The lift mechanism of claim 1, wherein the first cylinder extends from a closed end to a piston end, the closed end being attached to one of a first member upper end, a first member lower end, a second member upper end, and a second member lower end.

3. The lift mechanism of claim 1, comprising a third member moveable relative to the second member along a longitudinal axis.

4. The lift mechanism of claim 3, wherein the third member includes an upper end and a lower end, and wherein the first cylinder extends from a closed end to a piston end, the closed end being attached to one of the third member upper end, and the third member lower end.

5. The lift mechanism of claim 3, wherein the at least one wheel includes a first pulley and a second pulley, the lift mechanism comprising a synchronization assembly configured to partially transfer one of:

a) movement between the first member and the second member to movement between the second member and the third member, and b) movement between the second member and the third member to movement between the first member and the second member, wherein the synchronization assembly includes the first pulley rotatably connected to an upper end of the second member and the second pulley rotatably connected to a lower end of the second member.

6. The lift mechanism of claim 1, comprising a work surface attached to an upper end of the lift mechanism.

7. The lift mechanism of claim 1, wherein the second member is configured to fit inside the first member and form a telescoping assembly.

8. The lift mechanism of claim 1, wherein the first cylinder extends from a first closed end to a first piston end, the first closed end being attached to a second member upper end, and wherein the second cylinder extends from a second closed end to a second piston end, the second closed end being attached to a second member lower end.

9. A lift mechanism comprising:

a first member; and a second member moveable relative to the first member along a longitudinal axis, the second member having an upper end and a lower end, the first member sized and arranged to fit inside the second member and form a telescoping assembly; and a counterbalance mechanism configured to counteract a force exerted on the lift mechanism, the counterbalance mechanism including:

a first gas spring having a moveable piston slidably attached to a first cylinder, the first cylinder attached to the lift mechanism, the first cylinder extending from a first closed end to a first piston end, the first closed end being attached to the second member upper end;

a second gas spring having a moveable piston slidably attached to a second cylinder, the second cylinder attached to the lift mechanism, the second gas spring extending in an opposite direction from the first gas spring, the second cylinder extending from a second closed end to a second piston end, the second closed end being attached to the second member lower end; and at least one wheel rotatably connected to the second member; and a tension member engaged to the wheel, the tension member having a first end and a second end, the first end attached to the lift mechanism.

10. The lift mechanism of claim 9, comprising a third member moveable relative to the second member along a longitudinal axis.

11. The lift mechanism of claim 10, wherein the second member is sized and arranged to fit inside the third member.

* * * * *